US009222623B2

(12) United States Patent
Wright et al.

(10) Patent No.: US 9,222,623 B2
(45) Date of Patent: Dec. 29, 2015

(54) DEVICES AND METHODS FOR MANIPULATING DEFORMABLE FLUID VESSELS

(71) Applicant: GENMARK DIAGNOSTICS, INC., Carlsbad, CA (US)

(72) Inventors: David Walter Wright, Littleton, CO (US); Dominic Aiello, Denver, CO (US)

(73) Assignee: GENMARK DIAGNOSTICS, INC., Carlsbad, CA (US)

( * ) Notice: Subject to any disclaimer, the term of this patent is extended or adjusted under 35 U.S.C. 154(b) by 0 days.

(21) Appl. No.: 14/206,867

(22) Filed: Mar. 12, 2014

(65) Prior Publication Data

US 2014/0261708 A1 Sep. 18, 2014

Related U.S. Application Data

(60) Provisional application No. 61/798,091, filed on Mar. 15, 2013.

(51) Int. Cl.

| | |
|---|---|
| ***F17D 1/08*** | (2006.01) |
| ***B65D 83/00*** | (2006.01) |
| ***B65D 35/30*** | (2006.01) |
| ***B65D 35/56*** | (2006.01) |
| ***B01L 3/00*** | (2006.01) |

(52) U.S. Cl.

CPC . *F17D 1/08* (2013.01); *B01L 3/502* (2013.01); *B01L 3/505* (2013.01); *B01L 3/523* (2013.01); *B65D 35/30* (2013.01); *B65D 35/56* (2013.01); *B65D 83/0055* (2013.01); *B01L 2300/0672* (2013.01); *B01L 2300/0816* (2013.01); *B01L 2400/0481* (2013.01); *B01L 2400/0683* (2013.01); *Y10T 137/0318* (2015.04); *Y10T 137/87917* (2015.04)

(58) Field of Classification Search

CPC ..... F17D 1/08; B01L 3/523

See application file for complete search history.

(56) References Cited

U.S. PATENT DOCUMENTS

| | | | |
|---|---|---|---|
| 3,641,909 | A | 2/1972 | Baker |
| 3,687,051 | A | 8/1972 | Baker et al. |
| 3,776,425 | A | 12/1973 | Baker et al. |

(Continued)

FOREIGN PATENT DOCUMENTS

| | | |
|---|---|---|
| EP | 0173547 | 6/1990 |
| EP | 0583833 A2 | 2/1994 |

(Continued)

OTHER PUBLICATIONS

International Search Report and Written Opinion issued in Application No. PCT/US2013/0066717, 35 pages (Feb. 3, 2014).

(Continued)

*Primary Examiner* — Jill Warden
*Assistant Examiner* — Matthew Krcha
(74) *Attorney, Agent, or Firm* — Rothwell, Figg, Ernst & Manbeck PC

(57) ABSTRACT

A fluid container comprises a first vessel, a second vessel connected or connectable to the first vessel, and a sealing partition preventing fluid flow from the second vessel. The container further includes a spherical opening element initially supported within the second vessel by the sealing partition and configured to be contacted with the sealing partition to open the sealing partition and permit fluid flow from the second vessel.

14 Claims, 17 Drawing Sheets

(56) References Cited

U.S. PATENT DOCUMENTS 3,820,149 A 6/1974 Baker et al.
4,007,010 A 2/1977 Woodbridge, III
4,182,447 A * 1/1980 Kay ..... 206/220
4,469,863 A 9/1984 Ts'o et al.
4,769,333 A 9/1988 Dole et al.
4,859,603 A 8/1989 Dole et al.
4,887,455 A 12/1989 Payne et al.
4,978,502 A 12/1990 Dole et al.
5,034,506 A 7/1991 Summerton et al.
5,089,233 A 2/1992 Devaney, Jr. et al.
5,098,660 A 3/1992 Devaney, Jr.
5,154,888 A 10/1992 Zander et al.
5,216,141 A 6/1993 Benner
5,229,297 A 7/1993 Schnipelsky et al.
5,234,809 A 8/1993 Boom et al.
5,235,033 A 8/1993 Summerton et al.
5,254,479 A 10/1993 Chemelli
5,288,463 A 2/1994 Chemelli
5,290,518 A 3/1994 Johnson
5,374,395 A 12/1994 Robinson et al.
5,386,023 A 1/1995 Sanghvi et al.
5,422,271 A 6/1995 Chen et al.
5,460,780 A 10/1995 Devaney, Jr. et al.
5,468,366 A 11/1995 Wegner et al.
5,512,439 A 4/1996 Hornes et al.
5,591,578 A 1/1997 Meade et al.
5,593,804 A 1/1997 Chemelli et al.
5,602,240 A 2/1997 De Mesmaeker et al.
5,637,684 A 6/1997 Cook et al.
5,644,048 A 7/1997 Yau
5,652,149 A 7/1997 Mileaf et al.
5,674,653 A 10/1997 Chemelli et al.
5,681,702 A 10/1997 Collins et al.
5,692,644 A 12/1997 Gueret
5,705,348 A 1/1998 Meade et al.
5,705,628 A 1/1998 Hawkins
5,714,380 A 2/1998 Neri et al.
5,716,852 A 2/1998 Yager et al.
5,726,404 A 3/1998 Brody
5,726,751 A 3/1998 Altendorf et al.
5,747,349 A 5/1998 Van Den Engh et al.
5,748,827 A 5/1998 Holl et al.
5,770,365 A 6/1998 Lane et al.
5,807,701 A 9/1998 Payne et al.
5,824,473 A 10/1998 Meade et al.
5,851,536 A 12/1998 Yager et al.
5,873,990 A 2/1999 Wojciechowski et al.
5,876,187 A 3/1999 Afromowitz et al.
5,882,497 A 3/1999 Persaud et al.
5,898,071 A 4/1999 Hawkins
5,932,100 A 8/1999 Yager et al.
5,948,684 A 9/1999 Weigl et al.
5,955,028 A 9/1999 Chow
5,971,158 A 10/1999 Yager et al.
5,972,710 A 10/1999 Weigl et al.
5,973,138 A 10/1999 Collis
5,974,867 A 11/1999 Forster et al.
6,007,775 A 12/1999 Yager
6,013,170 A 1/2000 Meade
6,013,459 A 1/2000 Meade
6,033,601 A 3/2000 Persaud et al.
6,039,897 A 3/2000 Lochhead et al.
6,063,573 A 5/2000 Kayyem
6,067,157 A 5/2000 Altendorf
6,071,478 A 6/2000 Chow
6,090,933 A 7/2000 Kayyem et al.
6,091,502 A 7/2000 Weigl et al.
6,096,273 A 8/2000 Kayyem et al.
6,110,354 A 8/2000 Saban et al.
6,134,950 A 10/2000 Forster et al.
6,136,272 A 10/2000 Weigl et al.
6,159,739 A 12/2000 Weigl et al.
6,167,910 B1 1/2001 Chow
6,171,865 B1 1/2001 Weigl et al.
6,180,064 B1 1/2001 Persaud et al.
6,180,114 B1 1/2001 Yager et al.
6,190,858 B1 2/2001 Persaud et al.
6,192,351 B1 2/2001 Persaud
6,221,583 B1 4/2001 Kayyem et al.
6,221,677 B1 4/2001 Wu et al.
6,227,809 B1 5/2001 Forster et al.
6,232,062 B1 5/2001 Kayyem et al.
6,235,501 B1 5/2001 Gautsch et al.
6,236,951 B1 5/2001 Payne et al.
6,248,229 B1 6/2001 Meade
6,255,477 B1 7/2001 Kleiber et al.
6,264,825 B1 7/2001 Blackburn et al.
6,265,155 B1 7/2001 Meade et al.
6,268,136 B1 7/2001 Shuber et al.
6,277,641 B1 8/2001 Yager
6,290,839 B1 9/2001 Kayyem et al.
6,297,061 B1 10/2001 Wu et al.
6,300,138 B1 10/2001 Gleason et al.
6,321,791 B1 11/2001 Chow
6,361,958 B1 3/2002 Shieh et al.
6,366,924 B1 4/2002 Parce
6,376,232 B1 4/2002 Payne et al.
6,387,290 B1 5/2002 Brody et al.
6,391,558 B1 5/2002 Henkens et al.
6,399,023 B1 6/2002 Chow
6,399,025 B1 6/2002 Chow
6,403,338 B1 6/2002 Knapp et al.
6,404,493 B1 6/2002 Altendorf
6,406,857 B1 6/2002 Shuber et al.
6,408,884 B1 6/2002 Kamholz et al.
6,409,832 B2 6/2002 Weigl et al.
6,415,821 B2 7/2002 Kamholz et al.
6,426,230 B1 7/2002 Feistel
6,431,016 B1 8/2002 Payne
6,431,212 B1 8/2002 Hayenga et al.
6,431,476 B1 8/2002 Taylor et al.
6,432,720 B2 8/2002 Chow
6,432,723 B1 8/2002 Plaxco et al.
6,433,160 B1 8/2002 Collis
6,440,725 B1 8/2002 Pourahmadi et al.
6,443,307 B1 9/2002 Burridge
6,451,606 B1 9/2002 König et al.
6,454,945 B1 9/2002 Weigl et al.
6,479,240 B1 11/2002 Kayyem et al.
6,482,306 B1 11/2002 Yager et al.
6,488,896 B2 12/2002 Weigl et al.
6,494,230 B2 12/2002 Chow
6,495,104 B1 12/2002 Unno et al.
6,495,323 B1 12/2002 Kayyem et al.
6,503,757 B1 1/2003 Chow
6,518,024 B2 2/2003 Choong et al.
6,524,456 B1 2/2003 Ramsey et al.
6,537,501 B1 3/2003 Holl et al.
6,541,213 B1 4/2003 Weigl et al.
6,541,617 B1 4/2003 Bamdad et al.
6,557,427 B2 5/2003 Weigl et al.
6,562,568 B1 5/2003 Kleiber et al.
6,565,727 B1 5/2003 Shenderov
6,575,188 B2 6/2003 Parunak
6,576,194 B1 6/2003 Holl et al.
6,581,899 B2 6/2003 Williams
6,582,963 B1 6/2003 Weigl et al.
6,596,483 B1 7/2003 Choong et al.
6,600,026 B1 7/2003 Yu
6,602,400 B1 8/2003 Choong et al.
6,627,412 B1 9/2003 Manning et al.
6,642,046 B1 11/2003 McGarry et al.
6,645,758 B1 11/2003 Schnipelsky et al.
6,647,397 B2 11/2003 Parce
6,648,015 B1 11/2003 Chow
6,655,010 B1 12/2003 Hatfield et al.
6,656,431 B2 12/2003 Holl et al.
6,660,480 B2 12/2003 Ramsey et al.
6,664,104 B2 12/2003 Pourahmadi et al.
6,674,525 B2 1/2004 Bardell et al.
6,686,150 B1 2/2004 Blackburn et al.
6,695,147 B1 2/2004 Yager et al.
6,706,498 B2 3/2004 Gautsch et al.
6,712,925 B1 3/2004 Holl et al.

(56) References Cited

U.S. PATENT DOCUMENTS 6,739,531 B2 5/2004 Taylor
6,740,518 B1 5/2004 Duong et al.
6,742,661 B1 6/2004 Schulte et al.
6,743,399 B1 6/2004 Weigl et al.
6,753,143 B2 6/2004 Tao et al.
6,761,816 B1 7/2004 Blackburn et al.
6,773,566 B2 8/2004 Shenderov
6,783,647 B2 8/2004 Culbertson et al.
6,790,341 B1 9/2004 Saban et al.
6,824,669 B1 11/2004 Li et al.
6,830,729 B1 12/2004 Holl et al.
6,833,267 B1 12/2004 Kayyem
6,852,284 B1 2/2005 Holl et al.
6,857,449 B1 2/2005 Chow
6,875,619 B2 4/2005 Blackburn
6,878,540 B2 4/2005 Pourahmadi et al.
6,881,541 B2 4/2005 Petersen et al.
6,887,693 B2 5/2005 McMillan et al.
6,893,879 B2 5/2005 Petersen et al.
6,914,137 B2 7/2005 Baker
6,919,444 B2 7/2005 Harttig et al.
6,942,771 B1 9/2005 Kayyem
6,951,759 B2 10/2005 Travers et al.
6,960,437 B2 11/2005 Enzelberger et al.
6,960,467 B2 11/2005 Shieh et al.
6,977,151 B2 12/2005 Kayyem et al.
6,979,424 B2 12/2005 Northrup et al.
7,010,391 B2 3/2006 Handique et al.
7,011,791 B2 3/2006 Weigl et al.
7,014,992 B1 3/2006 Kayyem et al.
7,018,523 B2 3/2006 Meade
7,030,989 B2 4/2006 Yager et al.
7,045,285 B1 5/2006 Kayyem et al.
7,056,475 B2 6/2006 Lum et al.
7,056,669 B2 6/2006 Kayyem et al.
7,087,148 B1 8/2006 Blackburn et al.
7,090,804 B2 8/2006 Kayyem et al.
7,119,194 B2 10/2006 Uematsu et al.
7,125,668 B2 10/2006 Kayyem et al.
7,141,429 B2 11/2006 Munson et al.
7,155,344 B1 12/2006 Parce et al.
7,160,678 B1 1/2007 Kayyem et al.
7,163,612 B2 1/2007 Sterling et al.
7,169,358 B2 1/2007 Henkens et al.
7,172,897 B2 2/2007 Blackburn et al.
7,192,557 B2 3/2007 Wu et al.
7,201,881 B2 4/2007 Cox et al.
7,208,271 B2 4/2007 Bost et al.
7,223,371 B2 5/2007 Hayenga et al.
7,226,562 B2 6/2007 Holl et al.
7,238,268 B2 7/2007 Ramsey et al.
7,255,780 B2 8/2007 Shenderov
7,258,837 B2 8/2007 Yager et al.
7,267,939 B2 9/2007 Meade
7,270,786 B2 9/2007 Parunak et al.
7,271,007 B2 9/2007 Weigl et al.
7,312,087 B2 12/2007 Duong et al.
7,323,140 B2 1/2008 Handique et al.
7,343,248 B2 3/2008 Parce et al.
7,364,886 B2 4/2008 Hasenbank et al.
7,371,830 B2 5/2008 Kleiber et al.
7,381,525 B1 6/2008 Kayyem et al.
7,381,533 B2 6/2008 Kayyem et al.
7,384,749 B2 6/2008 Kayyem et al.
7,393,645 B2 7/2008 Kayyem et al.
7,405,054 B1 7/2008 Hasenbank et al.
7,416,791 B1 8/2008 Carlson et al.
7,416,892 B2 8/2008 Battrell et al.
7,419,575 B2 9/2008 Culbertson et al.
7,419,638 B2 9/2008 Saltsman et al.
7,439,014 B2 10/2008 Pamula et al.
7,473,397 B2 1/2009 Griffin et al.
7,491,495 B2 2/2009 Zielenski et al.
7,514,228 B2 4/2009 Meade
7,534,331 B2 5/2009 Kayyem
7,544,506 B2 6/2009 Breidford et al.
7,550,267 B2 6/2009 Hawkins et al.
7,560,237 B2 7/2009 O'Connor et al.
7,566,534 B2 7/2009 Meade
7,569,346 B2 8/2009 Petersen et al.
7,579,145 B2 8/2009 Meade
D599,832 S 9/2009 Chapin et al.
7,582,419 B2 9/2009 Meade
7,595,153 B2 9/2009 Meade
7,601,507 B2 10/2009 O'Connor et al.
7,648,835 B2 1/2010 Breidford et al.
7,655,129 B2 2/2010 Blackburn et al.
7,655,190 B2 2/2010 Satou et al.
7,659,089 B2 2/2010 Hasenbank et al.
7,713,711 B2 5/2010 O'Connor et al.
7,727,723 B2 6/2010 Pollack et al.
7,731,906 B2 6/2010 Handique et al.
7,736,891 B2 6/2010 Nelson et al.
7,759,073 B2 7/2010 O'Connor et al.
7,763,453 B2 7/2010 Clemmens et al.
7,763,471 B2 7/2010 Pamula et al.
7,789,270 B2 9/2010 Tanaami et al.
7,794,669 B2 9/2010 Gyonouchi et al.
7,815,871 B2 10/2010 Pamula et al.
7,816,121 B2 10/2010 Pollack et al.
7,820,030 B2 10/2010 Althaus et al.
7,820,391 B2 10/2010 Chunlin
7,822,510 B2 10/2010 Paik et al.
7,833,708 B2 11/2010 Enzelberger et al.
7,851,184 B2 12/2010 Pollack et al.
7,854,897 B2 12/2010 Tanaami et al.
7,858,045 B2 12/2010 Tanaami et al.
7,863,035 B2 1/2011 Clemens et al.
7,867,757 B2 1/2011 Karlsen et al.
7,901,947 B2 3/2011 Pollack et al.
7,910,294 B2 3/2011 Karlsen
7,914,994 B2 3/2011 Petersen et al.
7,919,330 B2 4/2011 De Guzman et al.
7,935,316 B2 5/2011 Gyonouchi et al.
7,935,481 B1 5/2011 Umek et al.
7,935,537 B2 5/2011 Haley
7,939,021 B2 5/2011 Smith et al.
7,943,030 B2 5/2011 Shenderov
7,955,836 B2 6/2011 Clemmens et al.
7,987,022 B2 7/2011 Handique et al.
7,998,436 B2 8/2011 Pollack et al.
7,998,708 B2 8/2011 Handique et al.
8,007,739 B2 8/2011 Pollack et al.
8,012,743 B2 9/2011 Bamdad et al.
8,017,340 B2 9/2011 Collier et al.
8,041,463 B2 10/2011 Pollack et al.
8,048,628 B2 11/2011 Pollack et al.
8,053,239 B2 11/2011 Wheeler et al.
8,088,578 B2 1/2012 Hua et al.
8,093,062 B2 1/2012 Winger
8,101,403 B2 1/2012 Yager et al.
8,101,431 B2 1/2012 McDevitt et al.
8,105,477 B2 1/2012 Althaus et al.
8,105,783 B2 1/2012 Handique
8,105,849 B2 1/2012 McDevitt et al.
8,110,392 B2 2/2012 Battrell et al.
8,114,661 B2 2/2012 O'Connor et al.
8,129,118 B2 3/2012 Weindel et al.
8,133,671 B2 3/2012 Williams et al.
8,133,703 B2 3/2012 Ching et al.
8,137,917 B2 3/2012 Pollack et al.
8,168,442 B2 5/2012 Petersen et al.
8,187,864 B2 5/2012 Wheeler et al.
8,201,765 B2 6/2012 Rajagopal et al.
8,202,686 B2 6/2012 Pamula et al.
8,202,736 B2 6/2012 Mousa et al.
8,208,146 B2 6/2012 Srinivasan et al.
8,216,529 B2 7/2012 Ade et al.
8,216,832 B2 7/2012 Battrell et al.
8,222,023 B2 7/2012 Battrell et al.
8,247,176 B2 8/2012 Petersen et al.
8,247,191 B2 8/2012 Ritzen et al.
8,268,246 B2 9/2012 Srinivasan et al.
8,273,308 B2 9/2012 Handique et al.

(56) References Cited

U.S. PATENT DOCUMENTS 8,304,253 B2 11/2012 Yi et al.
8,313,698 B2 11/2012 Pollack et al.
8,313,895 B2 11/2012 Pollack et al.
8,317,990 B2 11/2012 Pamula et al.
8,318,109 B2 11/2012 Saltsman et al.
8,318,439 B2 11/2012 Battrell et al.
8,323,900 B2 12/2012 Handique et al.
8,329,453 B2 12/2012 Battrell et al.
8,338,166 B2 12/2012 Beer et al.
8,343,636 B2 1/2013 Jen et al.
8,349,276 B2 1/2013 Pamula et al.
8,356,763 B2 1/2013 Rajagopal et al.
8,364,315 B2 1/2013 Sturmer et al.
8,367,370 B2 2/2013 Wheeler et al.
8,372,340 B2 2/2013 Bird et al.
8,388,909 B2 3/2013 Pollack et al.
8,389,297 B2 3/2013 Pamula et al.
8,394,608 B2 3/2013 Ririe et al.
8,394,641 B2 3/2013 Winger
8,404,440 B2 3/2013 Solli et al.
8,426,213 B2 4/2013 Eckhardt et al.
8,426,214 B2 4/2013 Stayton et al.
8,431,389 B2 4/2013 Battrell et al.
8,440,392 B2 5/2013 Pamula et al.
8,454,905 B2 6/2013 Pope et al.
8,460,528 B2 6/2013 Pollack et al.
8,470,606 B2 6/2013 Srinivasan et al.
8,481,125 B2 7/2013 Yi et al.
8,492,168 B2 7/2013 Srinivasan et al.
8,506,908 B2 8/2013 Benn et al.
8,518,662 B2 8/2013 Ritzen et al.
8,541,176 B2 9/2013 Pamula et al.
8,551,424 B2 10/2013 Abraham-Fuchs et al.
8,557,198 B2 10/2013 Saltsman et al.
8,562,807 B2 10/2013 Srinivasan et al.
8,580,209 B2 11/2013 Kurowski et al.
8,591,830 B2 11/2013 Sudarsan et al.
8,592,217 B2 11/2013 Eckhardt
8,613,889 B2 12/2013 Pollack et al.
8,637,317 B2 1/2014 Pamula et al.
8,637,324 B2 1/2014 Pollack et al.
8,658,111 B2 2/2014 Srinivasan et al.
8,685,344 B2 4/2014 Sudarsan et al.
8,685,754 B2 4/2014 Pollack et al.
2002/0006643 A1 1/2002 Kayyem et al.
2003/0025129 A1 2/2003 Hahn et al.
2003/0034271 A1 2/2003 Burridge
2003/0038040 A1* 2/2003 Bertl et al. ..... 206/63.5
2003/0048631 A1* 3/2003 Ladyjensky ..... 362/34
2003/0197139 A1 10/2003 Williams
2004/0037739 A1 2/2004 McNeely et al.
2004/0053290 A1 3/2004 Terbrueggen et al.
2004/0137607 A1 7/2004 Tanaami et al.
2004/0229378 A1 11/2004 Schulte et al.
2004/0254559 A1 12/2004 Tanaami et al.
2005/0164373 A1 7/2005 Oldham et al.
2005/0201903 A1 9/2005 Weigl et al.
2005/0205816 A1 9/2005 Hayenga et al.
2005/0244308 A1 11/2005 Tanaami et al.
2006/0057581 A1 3/2006 Karlsen et al.
2006/0079834 A1 4/2006 Tennican et al.
2006/0166233 A1 7/2006 Wu et al.
2006/0183216 A1 8/2006 Handique et al.
2006/0246575 A1 11/2006 Lancaster et al.
2006/0275813 A1 12/2006 Tanaami et al.
2006/0275852 A1 12/2006 Montagu et al.
2007/0013733 A1 1/2007 Katsurai et al.
2007/0042427 A1 2/2007 Gerdes et al.
2007/0178529 A1 8/2007 Breidford et al.
2007/0184547 A1 8/2007 Handique et al.
2007/0241068 A1 10/2007 Pamula et al.
2007/0242105 A1 10/2007 Srinivasan et al.
2007/0275415 A1 11/2007 Srinivasan et al.
2007/0292941 A1 12/2007 Handique et al.
2008/0038810 A1 2/2008 Pollack et al.
2008/0050287 A1 2/2008 Araragi et al.
2008/0182301 A1 7/2008 Handique et al.
2008/0227185 A1 9/2008 Schonfeld et al.
2008/0230386 A1 9/2008 Srinivasan et al.
2008/0248590 A1 10/2008 Gulliksen et al.
2008/0274513 A1 11/2008 Shenderov et al.
2008/0283439 A1 11/2008 Sullivan et al.
2009/0022624 A1 1/2009 Saltsman et al.
2009/0061450 A1 3/2009 Hunter
2009/0148847 A1 6/2009 Kokoris et al.
2009/0155902 A1 6/2009 Pollack et al.
2009/0221059 A1 9/2009 Williams et al.
2009/0221091 A1 9/2009 Mogi et al.
2009/0263834 A1 10/2009 Sista et al.
2009/0304944 A1 12/2009 Sudarsan et al.
2009/0325276 A1 12/2009 Battrell et al.
2010/0025250 A1 2/2010 Pamula et al.
2010/0032293 A1 2/2010 Pollack et al.
2010/0048410 A1 2/2010 Shenderov et al.
2010/0068764 A1 3/2010 Sista et al.
2010/0087012 A1 4/2010 Shenderov
2010/0116640 A1 5/2010 Pamula et al.
2010/0120130 A1 5/2010 Srinivasan et al.
2010/0130369 A1 5/2010 Shenderov et al.
2010/0150783 A1 6/2010 Araragi et al.
2010/0151475 A1 6/2010 Tanaami et al.
2010/0178697 A1 7/2010 Doebler et al.
2010/0190263 A1 7/2010 Srinivasan et al.
2010/0194408 A1 8/2010 Sturmer et al.
2010/0206094 A1 8/2010 Shenderov
2010/0224511 A1 9/2010 Boatner
2010/0226199 A1 9/2010 Mogi et al.
2010/0236928 A1 9/2010 Srinivasan et al.
2010/0236929 A1 9/2010 Pollack et al.
2010/0270156 A1 10/2010 Srinivasan et al.
2010/0279374 A1 11/2010 Sista et al.
2010/0282608 A1 11/2010 Srinivasan et al.
2010/0288789 A1 11/2010 Tanaami et al.
2010/0291578 A1 11/2010 Pollack et al.
2010/0297754 A1 11/2010 Solli et al.
2010/0307917 A1 12/2010 Srinivasan et al.
2010/0307922 A1 12/2010 Wu
2010/0308051 A1 12/2010 Weber
2010/0311599 A1 12/2010 Wheeler et al.
2010/0317093 A1 12/2010 Turewicz et al.
2010/0323405 A1 12/2010 Pollack et al.
2010/0331522 A1 12/2010 Irvine et al.
2011/0048951 A1 3/2011 Wu
2011/0076692 A1 3/2011 Sista et al.
2011/0086377 A1 4/2011 Thwar et al.
2011/0091989 A1 4/2011 Sista et al.
2011/0097763 A1 4/2011 Pollack et al.
2011/0104725 A1 5/2011 Pamula et al.
2011/0104747 A1 5/2011 Pollack et al.
2011/0104816 A1 5/2011 Pollack et al.
2011/0114490 A1 5/2011 Pamula et al.
2011/0180571 A1 7/2011 Srinivasan et al.
2011/0186433 A1 8/2011 Pollack et al.
2011/0186466 A1* 8/2011 Kurowski et al. ..... 206/524.6
2011/0203930 A1 8/2011 Pamula et al.
2011/0207621 A1 8/2011 Montagu et al.
2011/0209998 A1 9/2011 Shenderov
2011/0240471 A1 10/2011 Wheeler et al.
2011/0303542 A1 12/2011 Srinivasan et al.
2011/0311980 A1 12/2011 Pollack et al.
2011/0318824 A1 12/2011 Tanaami et al.
2011/0319279 A1 12/2011 Montagu et al.
2012/0018306 A1 1/2012 Srinivasan et al.
2012/0022695 A1 1/2012 Handique et al.
2012/0044299 A1 2/2012 Winger
2012/0064597 A1 3/2012 Clemmens et al.
2012/0071342 A1 3/2012 Lochhead et al.
2012/0083046 A1 4/2012 Watson et al.
2012/0085645 A1 4/2012 Mousa et al.
2012/0107811 A1 5/2012 Kelso et al.
2012/0122108 A1 5/2012 Handique
2012/0132528 A1 5/2012 Shenderov et al.
2012/0142070 A1 6/2012 Battrell et al.
2012/0156112 A1 6/2012 Sprague et al.

(56) References Cited

U.S. PATENT DOCUMENTS

| | | | |
|---|---|---|---|
| 2012/0156750 | A1 | 6/2012 | Battrell et al. |
| 2012/0160826 | A1 | 6/2012 | Handique |
| 2012/0164627 | A1 | 6/2012 | Battrell et al. |
| 2012/0165238 | A1 | 6/2012 | Pamula et al. |
| 2012/0171759 | A1 | 7/2012 | Williams et al. |
| 2012/0177543 | A1 | 7/2012 | Battrell et al. |
| 2012/0187117 | A1 | 7/2012 | Weber |
| 2012/0196280 | A1 | 8/2012 | Karlsen et al. |
| 2012/0252008 | A1 | 10/2012 | Brown et al. |
| 2012/0261264 | A1 | 10/2012 | Srinivasan et al. |
| 2012/0271127 | A1 | 10/2012 | Battrell et al. |
| 2012/0329142 | A1 | 12/2012 | Battrell et al. |
| 2013/0011912 | A1 | 1/2013 | Battrell et al. |
| 2013/0017544 | A1 | 1/2013 | Eckhardt et al. |
| 2013/0018611 | A1 | 1/2013 | Sturmer |
| 2013/0059366 | A1 | 3/2013 | Pollack et al. |
| 2013/0118901 | A1 | 5/2013 | Pollack et al. |
| 2013/0130262 | A1 | 5/2013 | Battrell et al. |
| 2013/0130936 | A1 | 5/2013 | Eckhardt |
| 2013/0142708 | A1 | 6/2013 | Battrell et al. |
| 2013/0146461 | A1 | 6/2013 | Pamula et al. |
| 2013/0164742 | A1 | 6/2013 | Pollack et al. |
| 2013/0178374 | A1 | 7/2013 | Eckhardt et al. |
| 2013/0178968 | A1 | 7/2013 | Sturmer et al. |
| 2013/0203606 | A1 | 8/2013 | Pollack et al. |
| 2013/0217103 | A1 | 8/2013 | Bauer |
| 2013/0217113 | A1 | 8/2013 | Srinivasan et al. |
| 2013/0225450 | A1 | 8/2013 | Pollack et al. |
| 2013/0225452 | A1 | 8/2013 | Pollack et al. |
| 2013/0230875 | A1 | 9/2013 | Pamula et al. |
| 2013/0233425 | A1 | 9/2013 | Srinivasan et al. |
| 2013/0233712 | A1 | 9/2013 | Pamula et al. |
| 2013/0252262 | A1 | 9/2013 | Srinivasan et al. |
| 2013/0302787 | A1 | 11/2013 | Agarwal et al. |
| 2013/0327672 | A1 | 12/2013 | Kurowski et al. |
| 2013/0331298 | A1 | 12/2013 | Rea |
| 2013/0341231 | A1 | 12/2013 | Lange et al. |
| 2014/0000223 | A1 | 1/2014 | Osterloh et al. |
| 2014/0000735 | A1 | 1/2014 | Weber et al. |
| 2014/0255275 | A1 | 9/2014 | Barry et al. |
| 2014/0263439 | A1 | 9/2014 | Wright et al. |
| 2014/0322706 | A1 | 10/2014 | Kayyem et al. |

FOREIGN PATENT DOCUMENTS

| | | | |
|---|---|---|---|
| EP | 0694483 | | 1/1996 |
| JP | 2009161187 | | 7/2009 |
| WO | WO 9937819 | | 7/1999 |
| WO | WO 00/62931 | | 10/2000 |
| WO | WO 01/10729 | | 2/2001 |
| WO | WO 2004/011148 | A2 | 2/2004 |
| WO | WO 2009/089466 | A2 | 7/2009 |
| WO | WO 2009/140373 | | 11/2009 |
| WO | WO 2010/151705 | A2 | 12/2010 |
| WO | WO 2012/080190 | A1 | 6/2012 |

OTHER PUBLICATIONS

"Mechanisms Information/Worksheets," World Association of Technology Teachers, 2 pages (Mar. 2, 2011). (animated display viewable at https://web.archive.org/web/20110302093447/http:www.technologystudent.com/cams/flat1.htm ).

Dobson et al., "Emerging Technologies for Point-of-Care Genetic Testing," *Future Drugs Ltd* (www.future-drugs.com), 10.1586/14737159.7.4.359, Expert Rev. Mol. Diagn., pp. 359-370 (2007).

Doebler et al., "Continuous-Flow, Rapid Lysis Devices for Biodefense Nucleic Acid Diagnostic Systems," *The Association for Laboratory Automation* (JALA), pp. 119-125 (Jun. 2009).

Erickson et al., "Integrated Microfluidic Devices," *Elsevier B.V.*, 16 pages (2003).

Findlay et al., "Automated Closed-Vessel System for in Vitro Diagnostics Based on Polymerase Chain Reaction," *Clinical Chemistry*, 39:9, pp. 1927-1933, 1993).

Focke et al., "Lab-on-a-Foil: Microfluidics on Thin and Flexible Films," *The Royal Society of Chemistry*, pp. 1365-1386 (2010).

Malic et al., "Current State of Intellectual Property in Microfluidic Nucleic Acid Analysis," McGill University, *Bentham Science Publishers*, 18 pages (2007).

Vandeventer et al., "Mechanical Disruption of Lysis-Resistant Bacterial Cells by Use of a Miniature, Low-Power, Disposable Device," American Society for Microbiology, *Journal of Clinical Microbiology*, 49:7, pp. 2533-2539 (Jul. 2011).

International Search Report and Written Opinion issued in International Patent Application No. PCT/US2014/024499, 14 pages (Dec. 11, 2014).

Beaucage et al., "Tetrahedron Report No. 329: The Functionalization of Oligonucleotides Via Phosphoramidite Derivatives," *Tetrahedron* vol. 49, No. 10, pp. 1925-2963 (1993).

Bolli et al., "α-Bicyclo-DNA: Synthesis, Characterization, and Pairing Properties of α-DNA-Analogues with Restricted Conformational Flexibility in the Sugar-Phosphate Backbone," *American Chemical Society*, pp. 100-117 (1994).

Brill et. al., "Synthesis of Oligodeoxynucleoside Phosphorodithioates via Thioamidites," *J. Am. Chem. Soc.*, pp. 2321-2322 (1989).

Carlsson et al., "Screening for Genetic Mutations" *Letters to Nature*, vol. 380, p. 207 (Mar. 1996).

Dempcy et al., "Synthesis of a Thymidyl Pentamer of Deoxyribonucleic Guanidine and Binding Studies with DNA Homopolynucleotides," *Proc. Natl. Acad. Sci. USA*, vol. 92, pp. 6097-6101 (Jun. 1995).

Egholm et al., "Peptide Nucleic Acids (PNA). Oligonucleotide Analogues with an Achiral Peptide Backbone," *J.Am.Chem.Soc.*, pp. 1895-1897 (1992).

Egholm et al., "PNA hybridizes to complementary oligonucleotides obeying the Watson-Crick hydrogen-bonding rules," *Letters to Nature*, pp. 566-568 (1993).

Herdewijn et al., "Hexopyranosyl-Like Oligonucleotides," *American Chemical Society*, pp. 80-99 (1994).

Horn et al., "Oligonucleotides with Alternating Anionic and Cationic Phosphoramidate Linkages: Synthesis and Hybridization of Stereo-Uniform Isomers," *Tetrahedron Letters*, vol. 37, No. 6, pp. 743-746 (1996).

Jeffs et al., "Unusual Confirmation of a 3-Thioformacetal Linkage in a DNA Duples," *Journal of Biomedecular NMR*, pp. 17-34 (1994).

Jenkins et al., "The Biosynthesis of Carbocyclic Nucleosides," *Chemical Society Reviews*, pp. 169-176 (Jan. 1995).

Kiedrowski et al., "Parabolic Growth of a Self-Replicating Hexadeoxynucleotide Bearing a 3'-5' Phosphoamidate Linkage," *Angew Chem. Intl. Ed. English 30*, pp. 423-426 (1991).

Koshkin et al., "LNA (Locked Nucleic Acid): An RNA Mimic Forming Exceedingly Stable LNA: LNA Duplexes," *J. Am. Chem. Soc.* vol. 120, pp. 13252-13253 (1998).

Letsinger et al., "Phosphoramidate Analogues of Oligonucleotides," *J. Org. Chem*, vol. 35, No. 1, pp. 3800-3803 (1970).

Letsinger et al., "Effects of Pendant Groups at Phosphorus on Binding Properties of d-APA Analogues," *Nucleic Acids Research* vol. 14, No. 8, pp. 3487-3499 (1986).

Letsinger et al., "Caionic Oligonucleotides," *J. Am. Chem. Soc.*, pp. 4470-4471 (1988).

Letsinger et al., "Hybridization of Alternating Cationic/ Anionic Oligonucleotides to RNA Segments," *Nucleosides & Nucleotides* vol. 13, No. 6&7, pp. 1597-1605 (1994).

Maddry et al., "Synthesis of Nonionic Oligonucleotide Analogues," *American Chemical Society*, pp. 40-51 (1994).

Mag et al., "Synthesis and Selective Clevage of a Oligodeoxynucleotide Containing a Bridged Internucleotide 5 Phosphorothioate Linkage," *Nucleic Acids Research*, vol. 19 No. 7, pp. 1437-1441 (1991).

Meier et al., "Peptide Nucleic Acids (PNA's)-Unusual Properties of Nonionic Oligonucleotide Analogues," *Angew Intl. Ed. English 31*, No. 8, pp. 1008-1010 (1992).

Mesmaeker et al., "Comparison of Rigid and Flexible Backbones in Antisense Oligonucleotides," *Bioorganic & Medicinal Chem. Letters*, vol. 4, No. 3, pp. 395-398 (1994).

Mesmaeker et al., "Novel Backbone Replacements for Oligonucleotides," *American Chemical Society*, pp. 24-39 (1994).

(56) References Cited

OTHER PUBLICATIONS

Pauwels et al., "Biological Activity of New 2-5A Analogues," *Chemica Scripta*, vol. 26, pp. 141-145 (1986).
Rawls "Optomistic About Antisense," *C&EN*, pp. 35-39 (Jun. 1997).
Sawai, "Synthesis and Properties of Oligoadenylic Acids Containing 2'-5' Phosphoramide Linkage," *Chemistry Letters*, pp. 805-808 (1984).
Sprinzl et al., "Enzymatic Incorporation of ATP and CTP Analogues into the 3' end of RNA," *Eur. J Biochem 81*, pp. 579-589 (1977).
International Search Report and Written Opinion issued in International Application No. PCT/US2013/06617, 35 pages (Feb. 3, 2014).
International Preliminary Report on Patentability and Written Opinion issued in International Application No. PCT/US2013/06617, 15 pages (Apr. 28, 2015).
Non-final Office Action issued in U.S. Appl. No. 14/062,860, 67 pages (Jul. 23, 2015).
Non-final Office Action issued in U.S. Appl. No. 14/206,817, 44 pages (Oct. 8, 2015).
International Preliminary Report on Patentability issued in International Application No. PCT/US2014/024499, 9 pages (Sep. 24, 2015).

* cited by examiner

DEVICES AND METHODS FOR MANIPULATING DEFORMABLE FLUID VESSELS

CROSS REFERENCE OF RELATED APPLICATION

This application claims the benefit under 35 U.S.C. §119 (e) of the filing date of provisional patent application Ser. No. 61/798,091 filed Mar. 15, 2013, the disclosure of which is incorporated herein by reference.

FIELD OF THE INVENTION

Aspects of the invention relate to systems, methods, and apparatus for selectively opening deformable fluid vessels. One aspect of the invention relates to generating compressive forces for compressing deformable fluid vessels to displace fluid therefrom in a low profile instrument. Other aspects of the invention relate to opening the deformable fluid vessel in a manner that reduces the amount of compressive force required to displace fluid from the vessel. Other aspects of the invention relate to an apparatus for protecting the deformable fluid vessel from inadvertent exposure to external forces and for interfacing with the vessel to permit intentional application of external compressive force without removing the vessel-protective features.

BACKGROUND OF INVENTION

The present invention relates to systems, methods, and apparatus for manipulating deformable fluid vessels. An exemplary device having such deformable fluid vessels is shown in FIGS. 1A and 1B. A liquid reagent module 10 includes a substrate 12 on which a plurality of deformable fluid vessels, or blisters, are attached. Devices such as the liquid reagent module 10 are often referred to as cartridges or cards. In an embodiment, the liquid reagent module 10 includes an input port 16, which may comprise a one-way valve, for dispensing a sample fluid into the module 10. A fluid channel 18 carries fluid from the input port 16. A sample vent 14 vents excess pressure from the module 10. A labeled panel 20 may be provided for an identifying label, such as a barcode or other human and/or machine-readable information.

Liquid reagent module 10 further includes a plurality of deformable (collapsible) vessels (blisters), including, in the illustrated embodiment, an elution reagent blister 22, a wash buffer blister 24, a water blister 26, a lysis reagent blister 28, an air blister 30, a binding agent blister 32, and an oil blister 34. Note that the number and types of blisters shown are merely exemplary. Each of the blisters may be interconnected with one or more other blisters and/or the fluid channel 18 by one or more fluid channels formed in or on the substrate 12.

The liquid reagent module 10 may be processed by selectively compressing one or more of the blisters to completely or partially collapse the blister to displace the fluid therefrom. Instruments adapted to process the liquid reagent module 10, or other devices with deformable fluid vessels, include mechanical actuators, e.g., typically pneumatically or electromechanically actuated, constructed and arranged to apply collapsing pressure to the blister(s). Typically, such actuator(s) is(are) disposed and are moved transversely to the plane of the module 10—for example, if module 10 were oriented horizontally within an instrument, actuators may be provided vertically above and/or below the module 10 and would be actuated to move vertically, in a direction generally normal to the plane of the module. The liquid reagent module 10 may be processed in an instrument in which the module 10 is placed into a slot or other low profile chamber for processing. In such a slot, or low profile chamber, providing actuators or other devices that are oriented vertically above and/or below the module 10 and/or move in a vertical direction may not be practical. The pneumatic and/or electromechanical devices for effecting movement of such actuators require space above and/or below the module's substrate, space that may not be available in a slotted or other low profile instrument.

Accordingly, a need exists for methods, systems, and/or apparatus for effecting movement of an actuator for collapsing a vessel within a low profile component space of an instrument.

SUMMARY OF THE INVENTION

Aspects of the invention are embodied in an apparatus for processing a fluid module including a collapsible vessel supported on a planar substrate by applying a force compressing the vessel against the substrate. The apparatus comprises a first actuator component configured to be movable in a first direction that is generally parallel to the plane of the substrate, a second actuator component configured to be movable in a second direction having a component that is generally normal to the plane of the substrate, and a motion conversion mechanism coupling the first actuator component with the second actuator component and constructed and arranged to convert movement of the first actuator component in the first direction into movement of the second actuator component in the second direction.

According to further aspects of the invention, the first actuator component comprises an actuator plate configured to be movable in the first direction and including a cam follower element, the second actuator component comprises a platen configured to be movable in the second direction, and the motion conversion mechanism comprises a cam body having a cam surface. The cam body is coupled to the platen and is configured such that the cam follower element of the actuator plate engages the cam surface of the cam body as the actuator plate moves in the first direction thereby causing movement of the cam body that results in movement of the platen in the second direction.

According to further aspects of the invention, the cam follower element of the actuator plate comprises a roller configured to rotate about an axis of rotation that is parallel to the actuator plate and normal to the first direction, the motion conversion mechanism further comprises a chassis, and the cam body is pivotally attached at one portion thereof to the chassis and at another portion thereof to the platen.

According to further aspects of the invention, the cam surface of the cam body comprises an initial flat portion and a convexly-curved portion, and movement of the roller from the initial flat portion to the convexly-curved portion causes the movement of the cam body that results in movement of the platen in the second direction.

According to further aspects of the invention, the first actuator component comprises a cam rail configured to be movable in the first direction, the second actuator component comprises a platen configured to be movable in the second direction, and the motion conversion mechanism comprises a cam surface and a cam follower coupling the cam rail to the platen and configured to convert motion of the cam rail in the first direction into movement of the platen in the second direction.

According to further aspects of the invention, the cam surface comprises a cam profile slot formed in the cam rail, and the cam follower comprises a follower element coupling the platen to the cam profile slot such that movement of the cam rail in the first direction causes movement of the cam follower within the cam profile slot that results in the movement of the platen in the second direction.

Further aspects of the invention are embodied in an apparatus for displacing fluid from a fluid container. The fluid container includes a first vessel and a second vessel connected or connectable to the first vessel and including a sealing partition preventing fluid flow from the second vessel, and the fluid container further includes an opening device configured to be contacted with the sealing partition to open the sealing partition and permit fluid flow from the second vessel. The apparatus comprises a first actuator configured to be movable with respect to the first vessel to compress the first vessel and displace fluid contents thereof and a second actuator movable with respect to the opening device and configured to contact the opening device and cause the opening device to open the sealing partition, The second actuator is releasably coupled to the first actuator such that the second actuator moves with the first actuator until the second actuator contacts the opening device and causes the opening device to open the sealing partition, after which the second actuator is released from the first actuator and the first actuator moves independently of the second actuator to displace fluid from the first vessel.

Further aspects of the invention are embodied in a fluid container comprising a first vessel, a second vessel connected or connectable to the first vessel, a sealing partition preventing fluid flow from the second vessel, and a spherical opening element initially supported within the second vessel by the sealing partition and configured to be contacted with the sealing partition to open the sealing partition and permit fluid flow from the second vessel.

Further aspects of the invention are embodied in a fluid container comprising a first vessel, a second vessel connected or connectable to the first vessel, a sealing partition preventing fluid flow from the second vessel, and a cantilevered lance having a piercing point and disposed with the piercing point adjacent to the sealing partition and configured to be deflected until the piercing point pierces the sealing partition to permit fluid flow from the second vessel through the pierced sealing partition.

Further aspects of the invention are embodied in a fluid container comprising a first vessel, a second vessel connected or connectable to the first vessel, a sealing partition preventing fluid flow from the second vessel, and a cantilevered lance having a piercing point and being fixed at an end thereof opposite the piercing point, the cantilevered lance being disposed with the piercing point adjacent to the sealing partition and configured to be deflected until the piercing point pierces the sealing partition to permit fluid flow from the second vessel through the pierced sealing partition.

According to further aspects of the invention, the fluid container further comprises a substrate on which the first and second vessels are supported and which includes a chamber formed therein adjacent the sealing partition wherein an end of the cantilevered lance is secured to the substrate and the piercing point of the lance is disposed within the chamber.

Further aspects of the invention are embodied in a fluid container comprising a first vessel, a second vessel connected or connectable to the first vessel, a sealing partition preventing fluid flow from the second vessel, and a lancing pin having a piercing point and disposed with the piercing point adjacent to the sealing partition and configured to be moved with respect to the sealing partition until the piercing point pierces the sealing partition to permit fluid flow from the second vessel through the pierced sealing partition.

According to further aspects of the invention, the lancing pin has a fluid port formed therethrough to permit fluid to flow through the lancing pin after the sealing partition is pierced by the piercing point.

According to further aspects of the invention, the fluid container further comprises a substrate on which the first and second vessels are supported and which includes a chamber formed therein adjacent the sealing partition within which the lancing pin is disposed.

According to further aspects of the invention, the chamber in which the lancing pin is disposed comprises a segmented bore defining a hard stop within the chamber and the lancing pin includes a shoulder that contacts the hard stop to prevent further movement of the lancing pin after the piercing point pierces the sealing partition.

According to further aspects of the invention, the fluid container further comprises a fluid channel extending between the first and second vessels.

According to further aspects of the invention, the fluid container of further comprises a seal within the fluid channel, the seal being configured to be breakable upon application of sufficient force to the seal to thereby connect the first and second vessels via the fluid channel.

Further aspects of the invention are embodied in a fluid container comprising a first vessel, a second vessel disposed within the first vessel, a substrate on which the first and second vessels are supported and having a cavity formed therein adjacent the second vessel, a fixed spike formed within the cavity, and a fluid exit port extending from the cavity, wherein the first and second vessels are configured such that external pressure applied to the first vessel will collapse the second vessel and cause the second vessel to contact and be pierced by the fixed spike, thereby allowing fluid to flow from the first vessel through the pierced second vessel, the cavity, and the fluid exit port.

Further aspects of the invention are embodied in a fluid container comprising a collapsible vessel configured to be collapsed upon application of sufficient external pressure to displace fluid from the vessel, a housing surrounding at least a portion of the collapsible vessel, and a floating compression plate movably disposed within the housing. The housing includes an opening configured to permit an external actuator to contact the floating compression plate within the housing and press the compression plate into the collapsible vessel to collapse the vessel and displace the fluid contents therefrom.

Other features and characteristics of the present invention, as well as the methods of operation, functions of related elements of structure and the combination of parts, and economies of manufacture, will become more apparent upon consideration of the following description and the appended claims with reference to the accompanying drawings, all of which form a part of this specification, wherein like reference numerals designate corresponding parts in the various figures.

BRIEF DESCRIPTION OF THE DRAWINGS

The accompanying drawings, which are incorporated herein and form part of the specification, illustrate various, non-limiting embodiments of the present invention. In the drawings, common reference numbers indicate identical or functionally similar elements.

DETAILED DESCRIPTION OF THE INVENTION

Figure 1A:
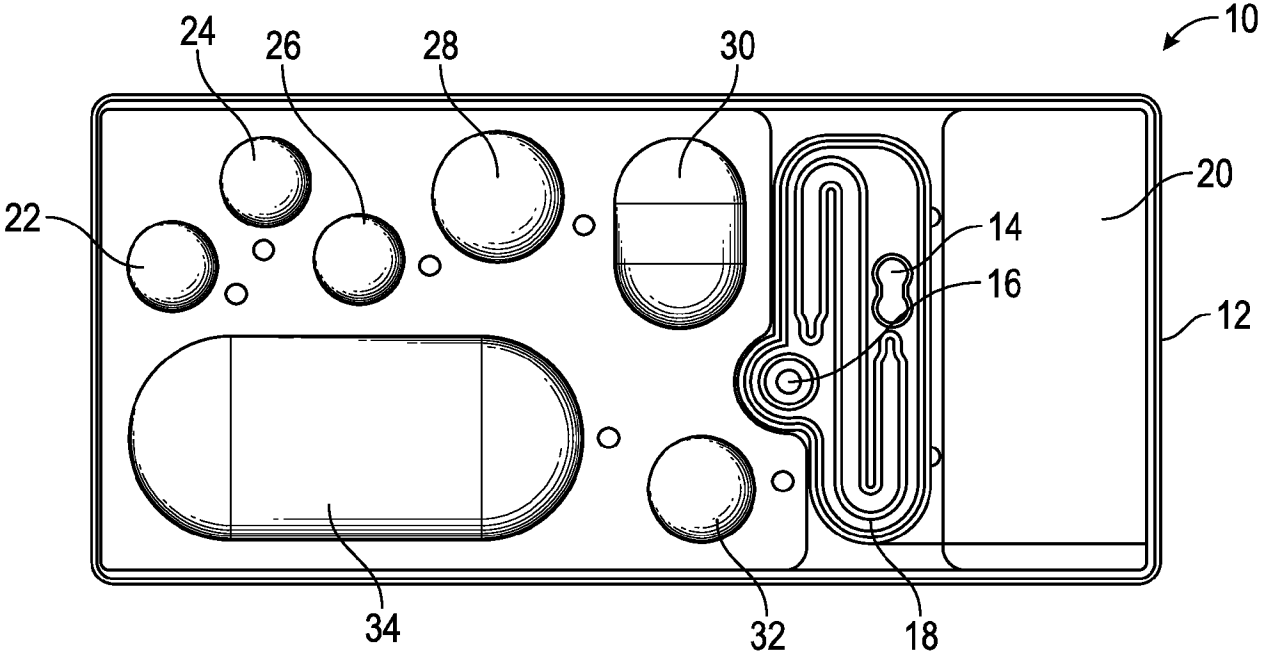
FIG. 1A is a top plan view of a liquid reagent module.
Figure 1B:
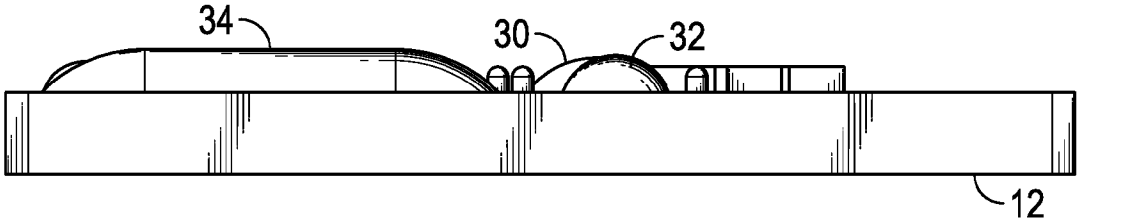
FIG. 1B is a side view of the liquid reagent module.

Unless defined otherwise, all terms of art, notations and other scientific terms or terminology used herein have the same meaning as is commonly understood by one of ordinary skill in the art to which this disclosure belongs. Many of the techniques and procedures described or referenced herein are well understood and commonly employed using conventional methodology by those skilled in the art. As appropriate, procedures involving the use of commercially available kits and reagents are generally carried out in accordance with manufacturer defined protocols and/or parameters unless otherwise noted. All patents, applications, published applications and other publications referred to herein are incorporated by reference in their entirety. If a definition set forth in this section is contrary to or otherwise inconsistent with a definition set forth in the patents, applications, published applications, and other publications that are herein incorporated by reference, the definition set forth in this section prevails over the definition that is incorporated herein by reference.

As used herein, "a" or "an" means "at least one" or "one or more."

This description may use relative spatial and/or orientation terms in describing the position and/or orientation of a component, apparatus, location, feature, or a portion thereof. Unless specifically stated, or otherwise dictated by the context of the description, such terms, including, without limitation, top, bottom, above, below, under, on top of, upper, lower, left of, right of, in front of, behind, next to, adjacent, between, horizontal, vertical, diagonal, longitudinal, transverse, etc., are used for convenience in referring to such component, apparatus, location, feature, or a portion thereof in the drawings and are not intended to be limiting.

Figure 2:
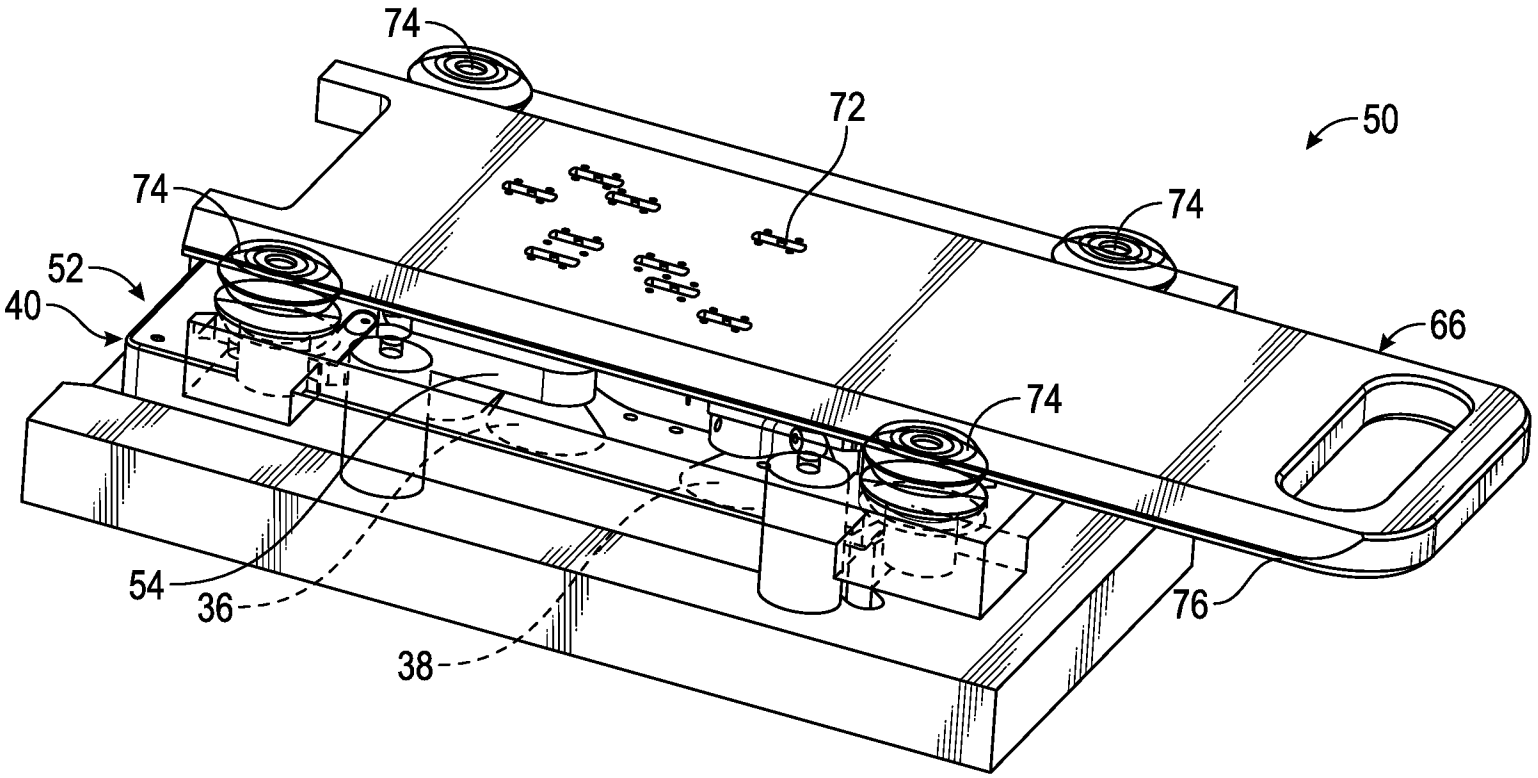
FIG. 2 is a perspective view of a blister compressing actuator mechanism embodying aspects of the present invention.

An actuator mechanism for compressing deformable fluid vessels—such as blisters on a liquid reagent module—embodying aspects of the present invention is shown at reference number 50 in FIG. 2. The actuator mechanism 50 may include an articulated blister actuator platen assembly 52 and a sliding actuator plate 66. The sliding actuator plate 66 is configured to be movable in a direction that is generally parallel to the plane of the liquid reagent module—horizontally in the illustrated embodiment—and may be driven by a linear actuator, a rack and pinion, a belt drive, or other suitable motive means. Sliding actuator plate 66, in the illustrated embodiment, has V-shaped edges 76 that are supported in four V-rollers 74 to accommodate movement of the plate 66 in opposite rectilinear directions, while holding the sliding actuator plate 66 at a fixed spacing from the actuator platen assembly 52. Other features may be provided to guide the actuator plate 66, such as rails and cooperating grooves. A component 40—which may comprise liquid reagent module 10 described above—having one or more deformable fluid vessels, such as blisters 36 and 38, is positioned within the actuator mechanism 50 beneath the articulated blister actuator platen assembly 52.

Further details of the configuration of the articulated blister actuator platen assembly 52 and the operation thereof are shown in FIGS. 3A-6B.

Figure 3A:
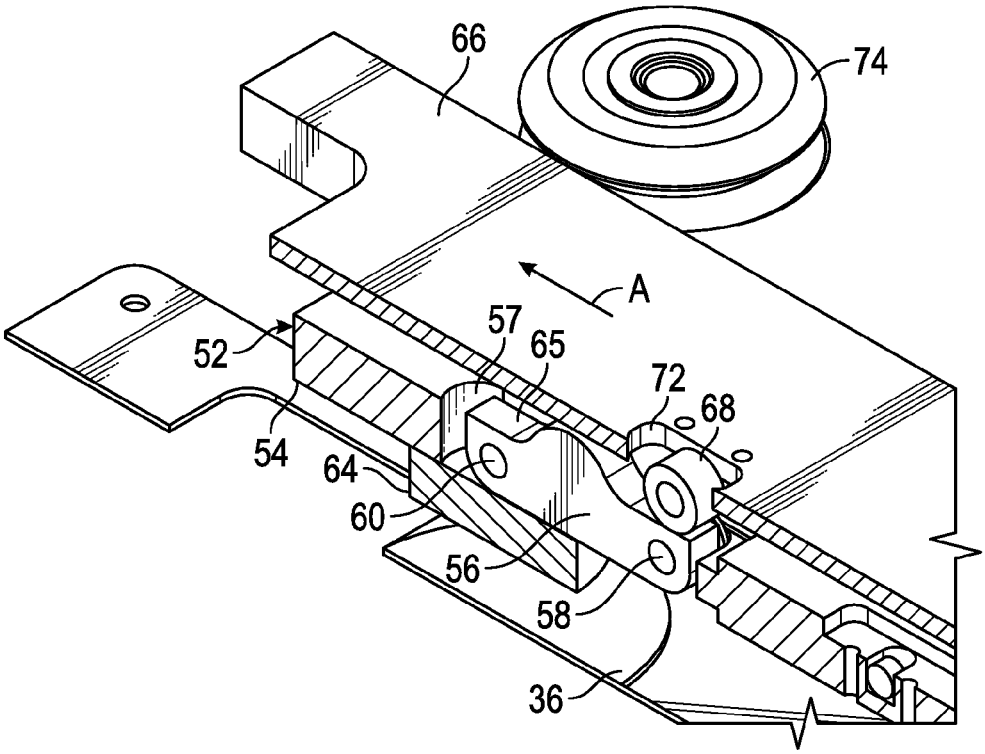
FIG. 3A is a partial, cross-sectional perspective view of the articulated blister actuator platen assembly in an initial, unactuated state.
Figure 3B:
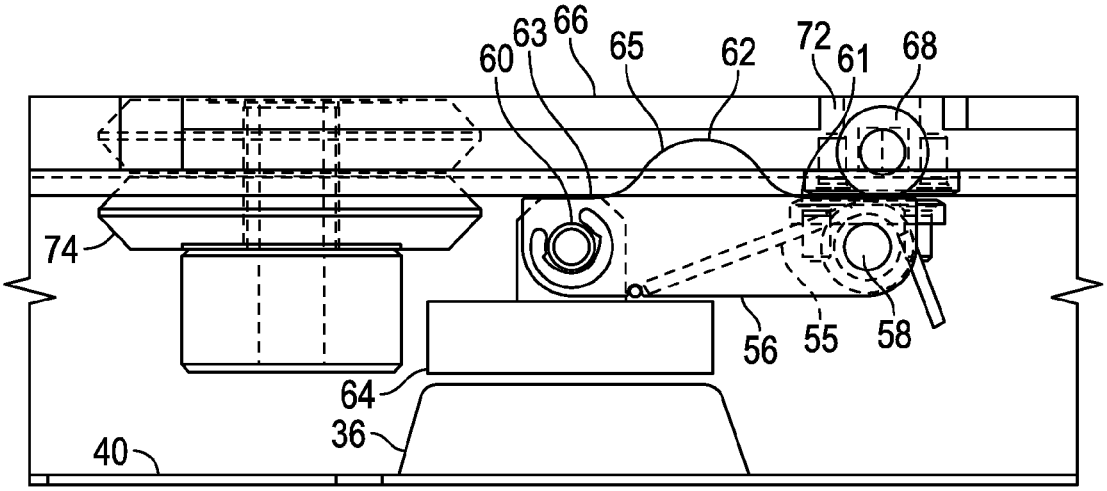
FIG. 3B is a partial, cross-sectional side view of the articulated blister actuator platen assembly in the initial unactuated state.

As shown in FIGS. 3A and 3B, the actuator platen assembly 52 includes a chassis 54. A cam body 56 is disposed within a slot 57 of the chassis 54 and is attached to the chassis 54 by a first pivot 58. A platen 64 is pivotally attached to the cam body 56 by means of a second pivot 60. The cam body 56 is held in a horizontal, unactuated position within the slot 57 by means of a torsional spring 55 coupled around the first pivot 58.

Cam body 56 further includes a cam surface 65 along one edge thereof (top edge in the figure) which, in the exemplary embodiment shown in FIG. 3B, comprises an initial flat portion 61, a convexly-curved portion 62, and a second flat portion 63. The sliding actuator plate 66 includes a cam follow 68 (a roller in the illustrated embodiment) rotatably mounted within a slot 72 formed in the actuator plate 66. In an embodiment of the invention, one cam body 56 and associated platen 64 and cam follower 68 are associated with each deformable vessel (e.g. blister 36) of the liquid reagent module 40.

The actuator platen assembly 52 and the sliding actuator plate 66 are configured to be movable relative to each other. In one embodiment, the actuator platen assembly 52 is fixed, and the actuator plate 66 is configured to move laterally relative to the platen assembly 52, supported by the V-rollers 74. Lateral movement of the sliding actuator plate 66, e.g., in the direction "A", causes the cam follower 68 to translate along the cam surface 65 of the cam body 56, thereby actuating the cam body 56 and the platen 64 attached thereto.

Figure 4A:
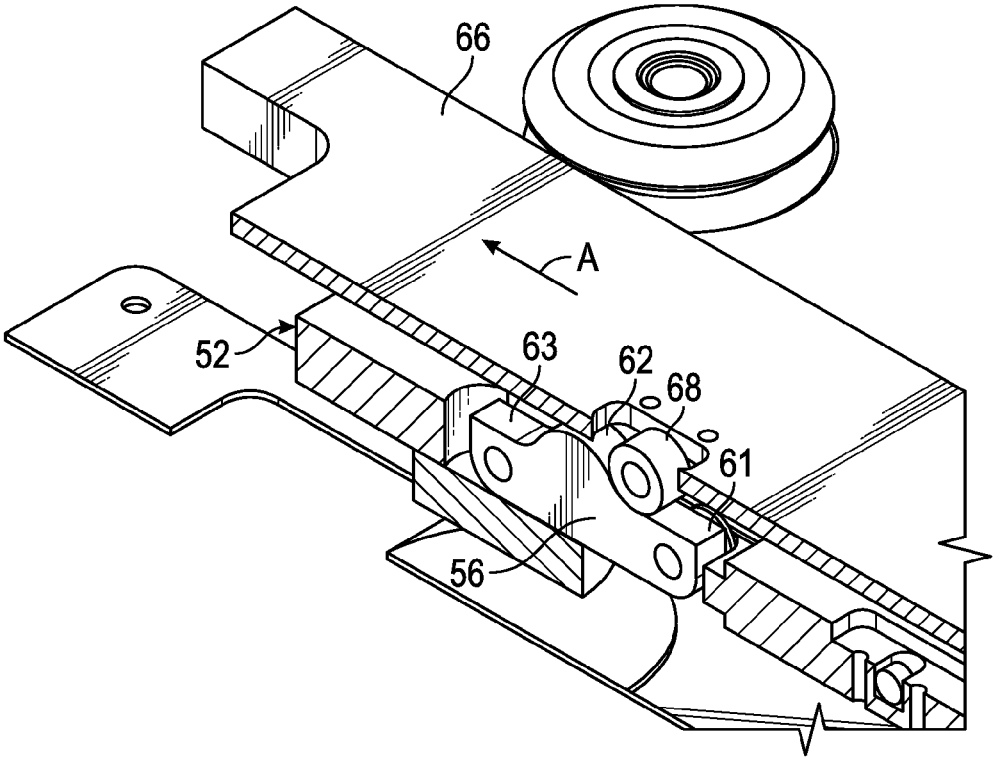
FIG. 4A is a partial, cross-sectional perspective view of the articulated blister actuator platen assembly as the platen is about to be actuated.
Figure 4B:
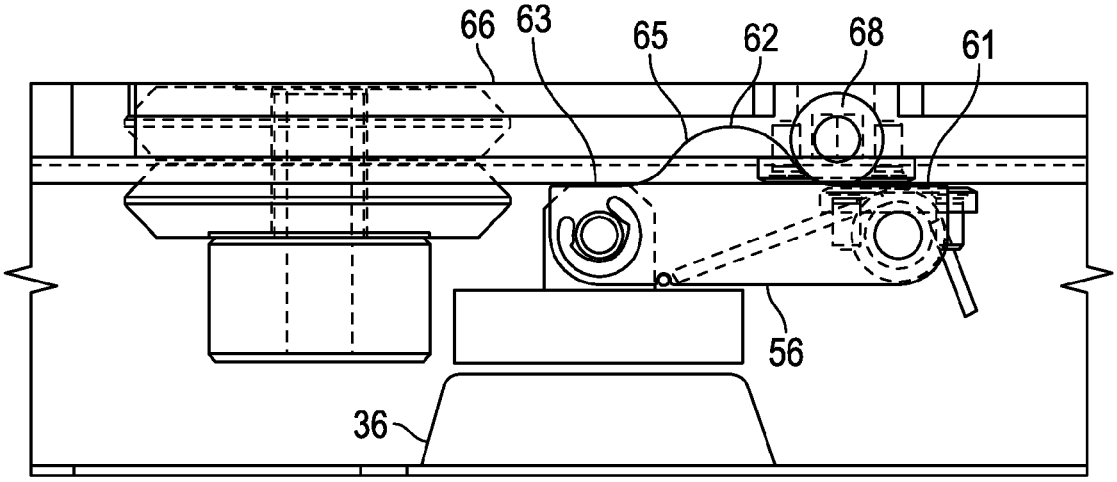
FIG. 4B is a partial, cross-sectional side view of the articulated blister actuator platen assembly as the platen is about to be actuated.

In FIGS. 3A and 3B, before the sliding actuator plate 66 has begun to move relative to the actuator platen assembly 52, the cam follower 68 is disposed on the initial flat portion 61 of the cam surface 65 of the cam body 56. In FIGS. 4A and 4B, the sliding actuator plate 66 has moved relative to the actuator platen assembly 52 in the direction "A" so that the cam follower 68 has moved across the initial flat portion 61 of the cam surface 65 and has just begun to engage the upwardly curved contour of the convexly-curved portion 62 of the cam surface 65 of the cam body 56.

Figure 5A:
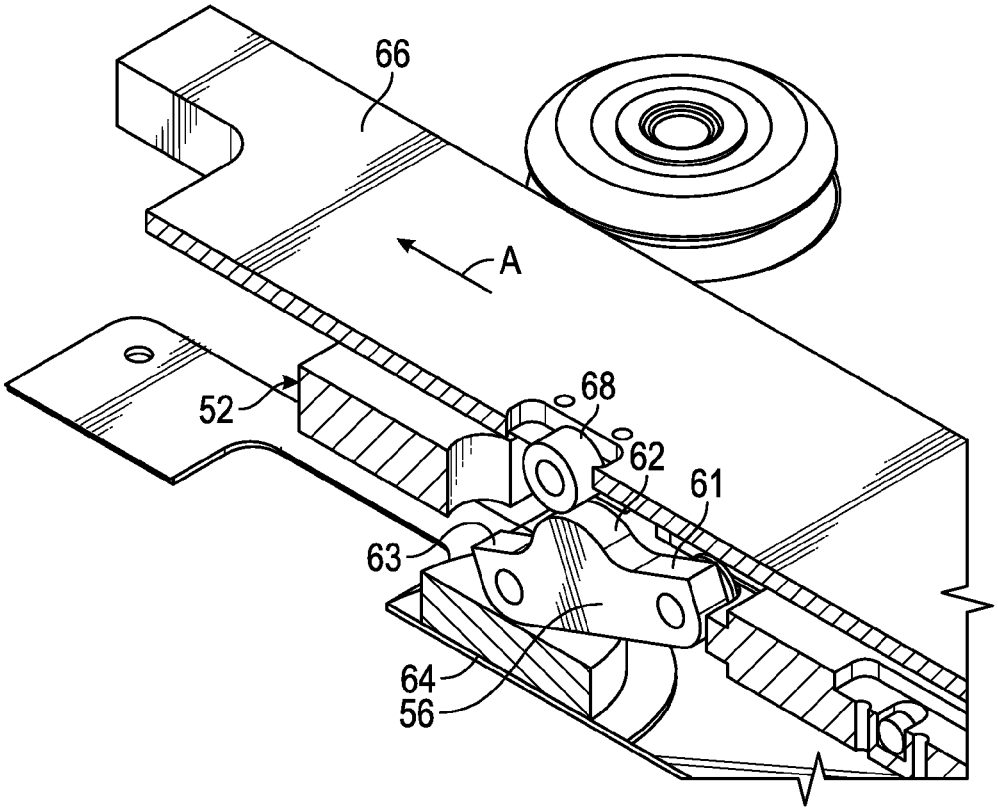
FIG. 5A is a partial, cross-sectional perspective view of the articulated blister actuator platen assembly with the platen in a fully actuated state.
Figure 5B:
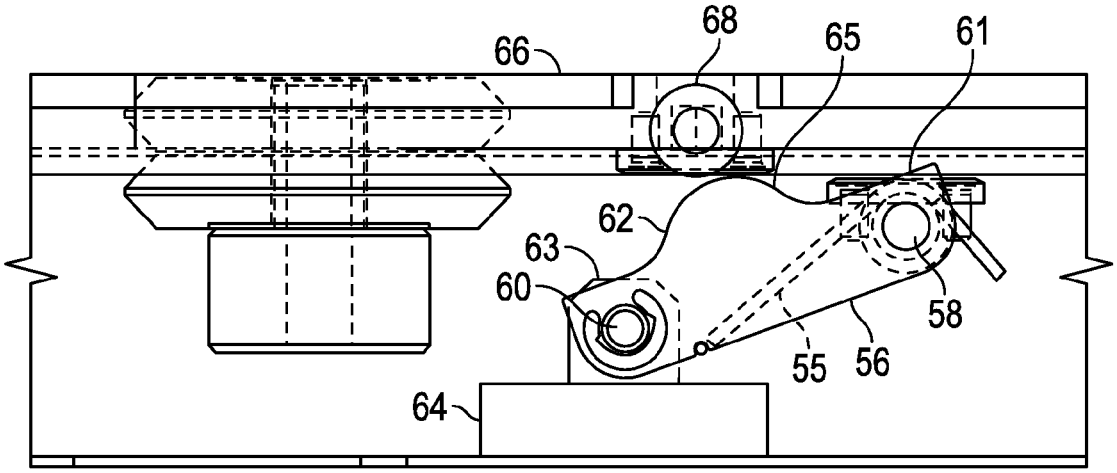
FIG. 5B is a partial, cross-sectional side view of the articulated blister actuator platen assembly with the platen in a fully actuated state.

In FIGS. 5A and 5B, the sliding actuator plate 66 has proceeded in the direction "A" to a point such that the cam follower 68 is at the topmost point of the convexly-curved portion 62 of the cam surface 65, thereby causing the cam body 56 to rotate about the first pivot 58. The platen 64 is lowered by the downwardly pivoting cam body 56 and pivots relative to the cam body 56 about the second pivot 60 and thereby compresses the blister 36.

Figure 6A:
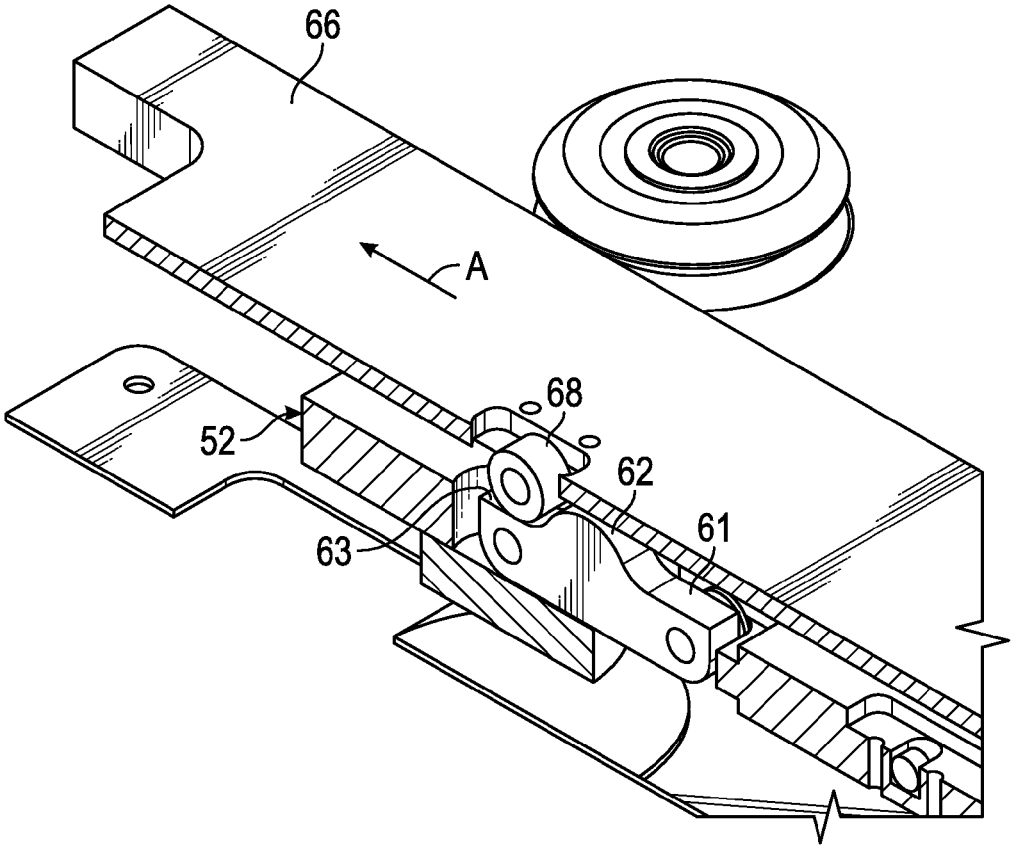
FIG. 6A is a partial, cross-sectional perspective view of the articulated blister actuator platen assembly with the platen returned to the unactuated state.
Figure 6B:
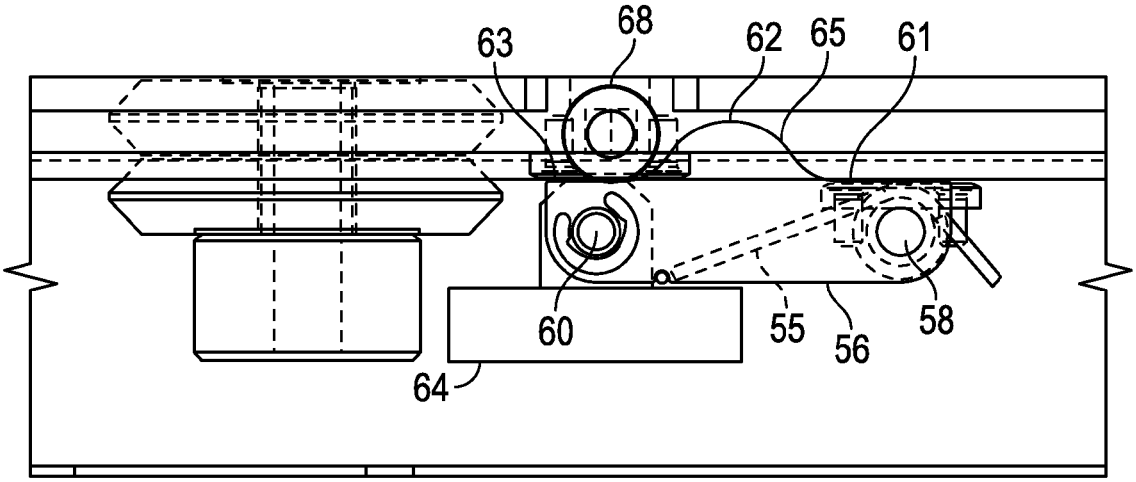
FIG. 6B is a partial, cross-sectional side view of the articulated blister actuator platen assembly with the platen returned to the unactuated state.

In FIGS. 6A and 6B, sliding actuator plate 66 has moved to a position in the direction "A" relative to the actuator platen assembly 52 such that the cam follower 68 has progressed to the second flat portion 63 of the cam surface 65. Accordingly, the cam body 56, urged by the torsion spring 55, pivots about the first pivot 58 back to the unactuated position, thereby retracting the platen 64.

Thus, the articulated blister actuator platen assembly 52 is constructed and arranged to convert the horizontal movement of actuator plate 66 into vertical movement of the platen 64 to compress a blister, and movement of the platen does not require pneumatic, electromechanical, or other components at larger distances above and/or below the liquid module.

Figure 7A:
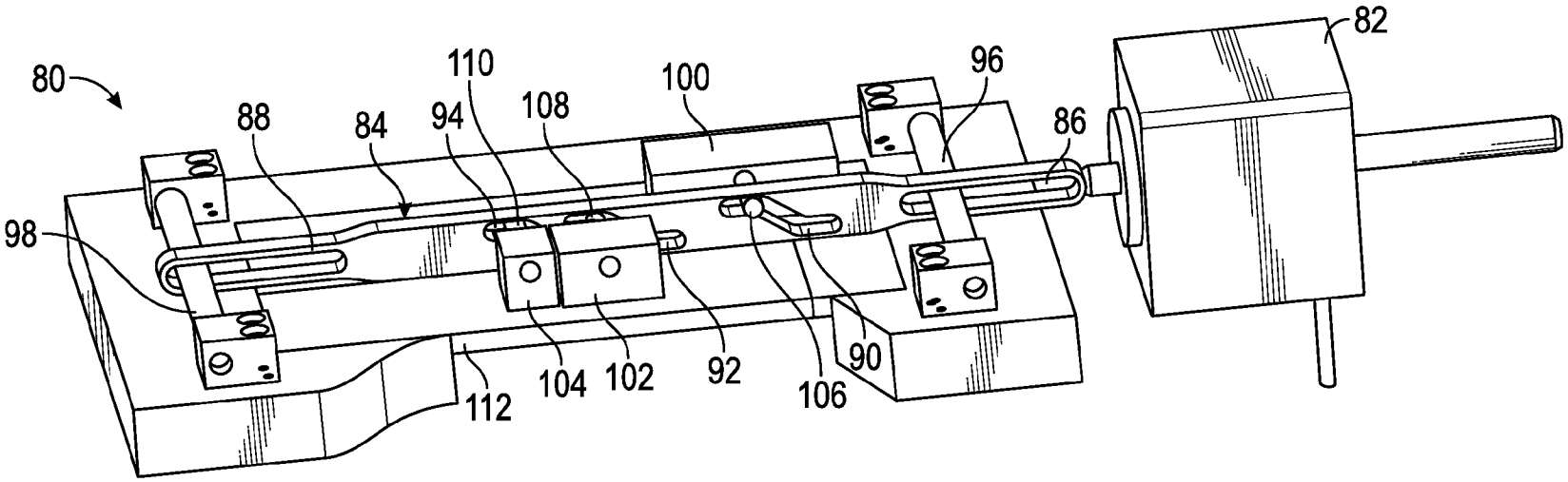
FIG. 7A is a perspective view of an alternative embodiment of a blister compressing actuator mechanism in an unactuated state.
Figure 7B:
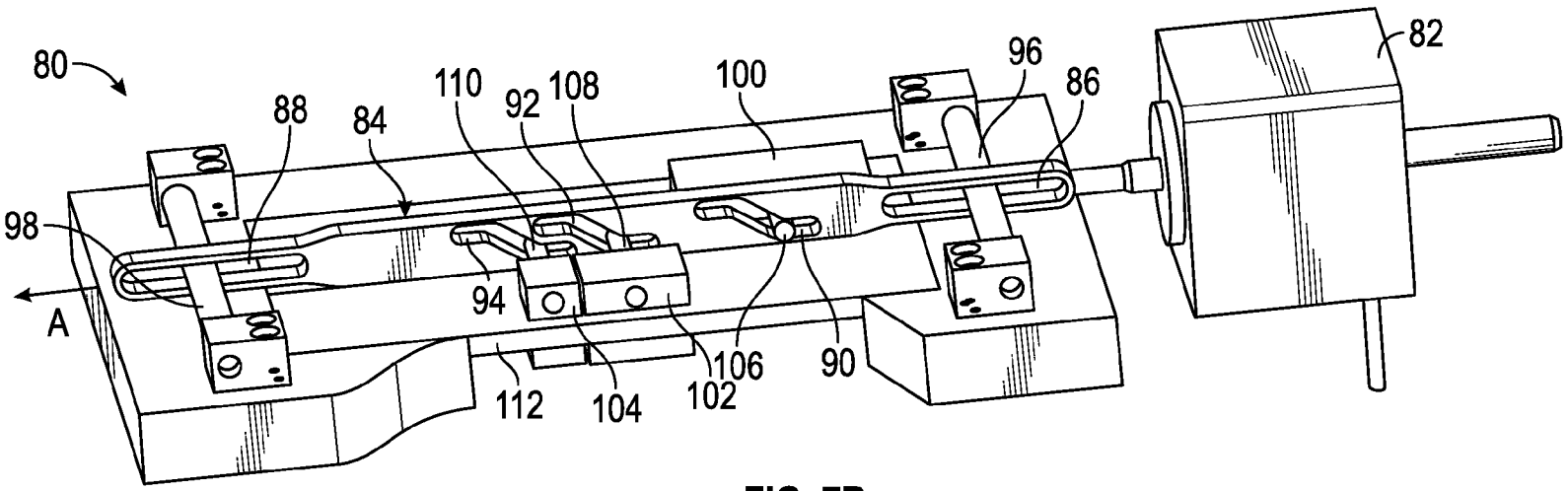
FIG. 7B is a perspective view of the blister compressing actuator mechanism of FIG. 7A in the fully actuated state.

An alternative embodiment of a blister compression actuator mechanism is indicated by reference number 80 in FIGS. 7A and 7B. Actuator 80 includes a linear actuator 82 that is coupled to a cam rail 84. Cam rail 84 is supported for longitudinal movement by a first support rod 96 extending transversely through slot 86 and a second support rod 98 extending transversely through a second slot 88 formed in the cam rail 84. The first support rod 96 and/or the second support rod 98 may include an annular groove within which portions of the cam rail 84 surrounding slot 86 or slot 88 may be supported, or cylindrical spacers may be placed over the first support rod 96 and/or the second support rod 98 on opposite sides of the cam rail 84 to prevent the cam rail 84 from twisting or sliding axially along the first support rail 96 and/or the second support rail 98.

Cam rail 84 includes one or more cam profile slots. In the illustrated embodiment, cam rail 84 includes three cam profile slots 90, 92, and 94. Referring to cam profile slot 90, in the illustrated embodiment, slot 90 includes, progressing from left to right in the figure, an initial horizontal portion, a downwardly sloped portion, and a second horizontal portion. The shapes of the cam profile slots are exemplary, and other shapes may be effectively implemented. The actuator mechanism 80 also includes a platen associated with each cam profile slot. In the illustrated embodiment, actuator 80 includes three platens 100, 102, 104 associated with cam profile slots 90, 92, 94, respectively. First platen 100 is coupled to the cam profile slot 90 by a cam follower pin 106 extending transversely from the platen 100 into the cam profile slot 90. Similarly, second platen 102 is coupled to the second cam profile slot 92 by a cam follower pin 108, and the third platen 104 is coupled to the third cam profile slot 94 by a cam follower pin 110. Platens 100, 102, 104 are supported and guided by a guide 112, which may comprise a panel having openings formed therein conforming to the shape of each of the platens.

In FIG. 7A, cam rail 84 is in its furthest right-most position, and the platens 100, 102, 104 are in their unactuated positions. Each of the cam follower pins 106, 108, 110 is in the initial upper horizontal portion of the respective cam profile slot 90, 92, 94. As the cam rail 84 is moved longitudinally to the left, in the direction "A" shown in FIG. 7B, by the linear actuator 82, each cam follower pin 106, 108, 110 moves within its respective cam profile slot 90, 92, 94 until the cam follower pin is in the lower, second horizontal portion of the respective cam profile slot. Movement of each of the pins 106, 108, 110 downwardly within its respective cam profile slot 90, 92, 94 causes a corresponding downward movement of the associated platen 100, 102, 104. This movement of the platens thereby compresses a fluid vessel (or blister) located under each platen. Each platen may compress a vessel directly in contact with the platen or it may contact the vessel through one or more intermediate components located between the vessel and the corresponding platen.

Thus, the blister compression actuator mechanism 80 is constructed and arranged to convert the horizontal movement cam rail 84, driven by the linear actuator 82, into vertical movement of the platens 100, 102, 104 to compress blisters, and movement of the platens does not require pneumatic, electromechanical, or other components at larger distances above and/or below the liquid module.

Figure 11:
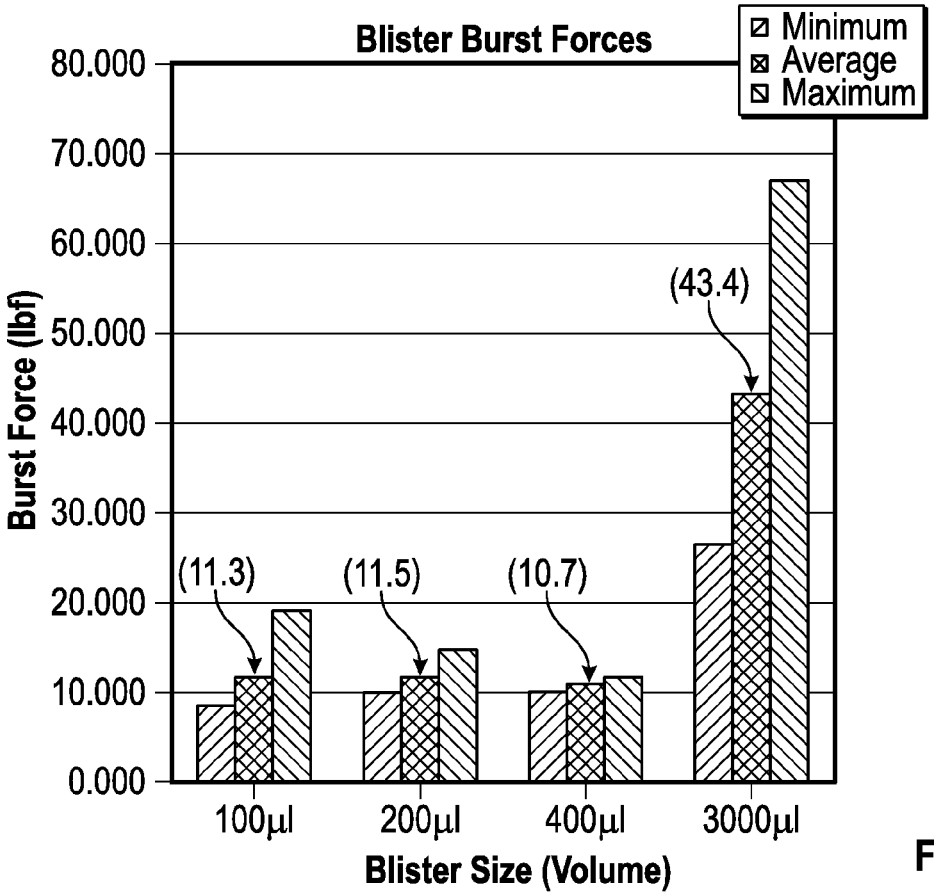
FIG. 11 is a bar graph showing exemplary burst forces for fluid-containing blisters of varying volumes.

When compressing a fluid vessel, or blister, to displace the fluid contents thereof, sufficient compressive force must be applied to the blister to break, or otherwise open, a breakable seal that is holding the fluid within the vessel. The amount of force required to break the seal and displace the fluid contents of a vessel typically increases as the volume of the vessel increases. This is illustrated in the bar graph shown in FIG. 11, which shows the minimum, maximum, and average blister burst forces required for blisters having volumes of 100, 200, 400, and 3000 microliters. The average force required to burst a blister of 400 or less microliters is relatively small, ranging from an average of 10.7 lbf to 11.5 lbf. On the other hand, the force required to burst a blister of 3000 microliters is substantially larger, with an average burst force of 43.4 lbf and a maximum required burst force of greater than 65 lbf. Generating such large forces can be difficult, especially in low profile actuator mechanisms, such as those described above, in which horizontal displacement of an actuator is converted into vertical, blister-compressing movement of a platen.

Accordingly, aspects of the present invention are embodied in methods and apparatus for opening a fluid vessel, or blister, in a manner that reduces the amount of force required to burst the vessel and displace the fluid contents of the vessel.

Figure 8A:
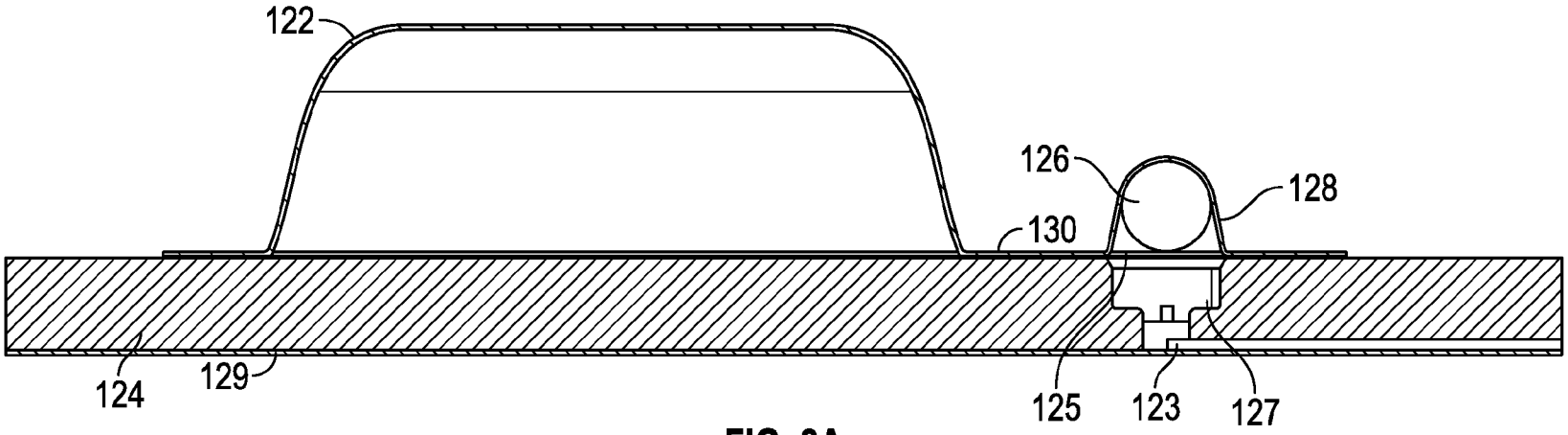
FIG. 8A is a partial, cross-sectional side view of a collapsible fluid vessel configured to facilitate opening of the vessel.
Figure 8B:
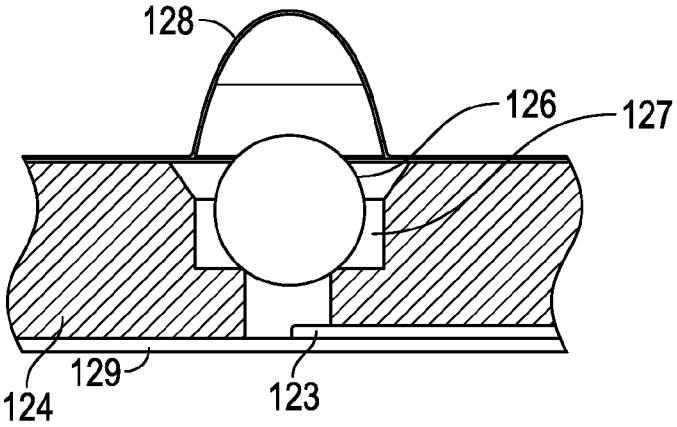
FIG. 8B is an enlarged partial, cross-sectional side view of a vessel opening feature of the collapsible fluid vessel.

Such aspects of the invention are illustrated in FIGS. 8A and 8B. As shown in FIG. 8A, a fluid vessel (or blister) 122 is mounted on a substrate 124 and is connected by means of a channel 130 to a sphere blister 128. In certain embodiments, channel 130 may be initially blocked by a breakable seal. A film layer 129 may be disposed on the bottom of the substrate 124 to cover one or more channels formed in the bottom of the substrate 124 to form fluid conduits. An opening device, comprising a sphere 126 (e.g., a steel ball bearing) is enclosed within the sphere blister 128 and is supported, as shown in FIG. 8A, within the sphere blister 128 by a foil partition or septum 125. The foil partition 125 prevents fluid from flowing from the vessel 122 through a recess 127 and fluid exit port 123. Upon applying downward force to the sphere 126, however, a large local compressive stress is generated due to the relatively small surface size of the sphere 126, and the foil partition 125 can be broken with relatively little force to push the sphere 126 through the partition 125 and into the recess 127, as shown in FIG. 8B. With the foil partition 125 broken, a relatively small additional force is required to break a seal within channel 130 and force the fluid to flow from the vessel 122 through the fluid exit port 123.

In FIG. 8B, the sphere blister 128 is shown intact. In some embodiments, a force applied to the sphere 126 to push it through the foil partition 125 would also collapse the sphere blister 128.

An apparatus for opening a vessel by pushing a sphere 126 through foil partition 125 is indicated by reference number 120 in FIGS. 9A, 9B, 9C, 9D. In the illustrated embodiment, the apparatus 120 includes a ball actuator 140 extending through an opening formed through a blister plate, or platen, 132. With the blister plate 132 and an actuator 138 configured for moving the blister plate 132 disposed above the vessel 122, the ball actuator 140 is secured in a first position, shown in FIG. 9A, by a detent 136 that engages a detent collar 144 formed in the ball actuator 140.

Figure 9A:
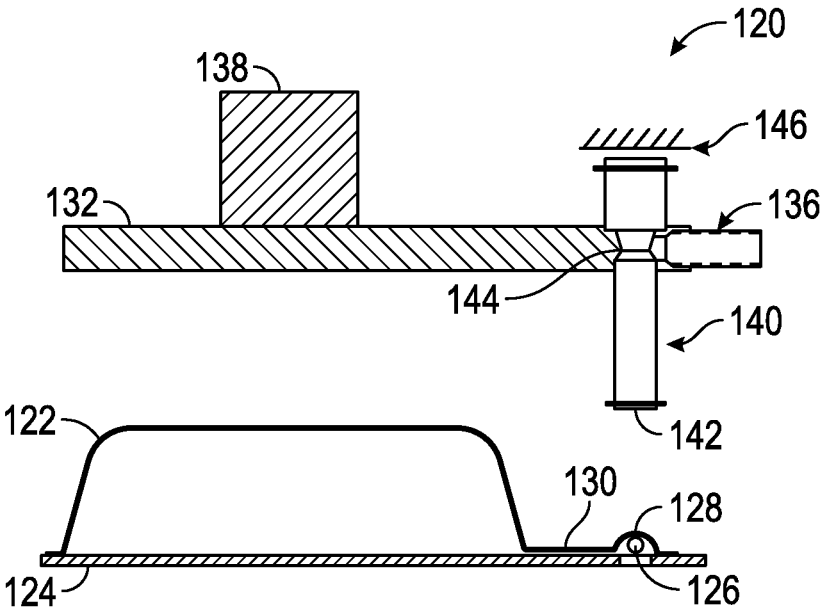
FIGS. 9A-9D are side views showing an apparatus for opening a collapsible vessel configured to facilitate opening of the vessel in various states.
Figure 9B:
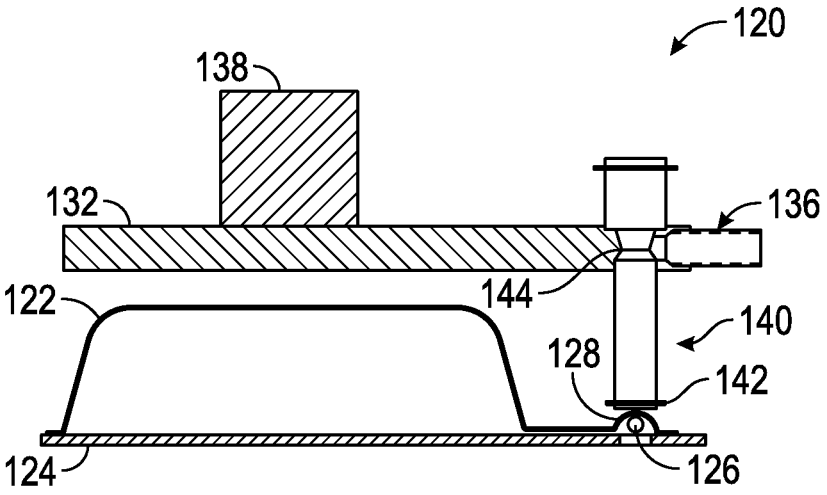

As shown in FIG. 9B, the blister plate 132 is moved by the actuator 138 down to a position in which a contact end 142 of the ball actuator 140 contacts the top of the of the sphere blister 128. Actuator 138 may comprise a low profile actuator, such as actuator mechanisms 50 or 80 described above.

Figure 9C:
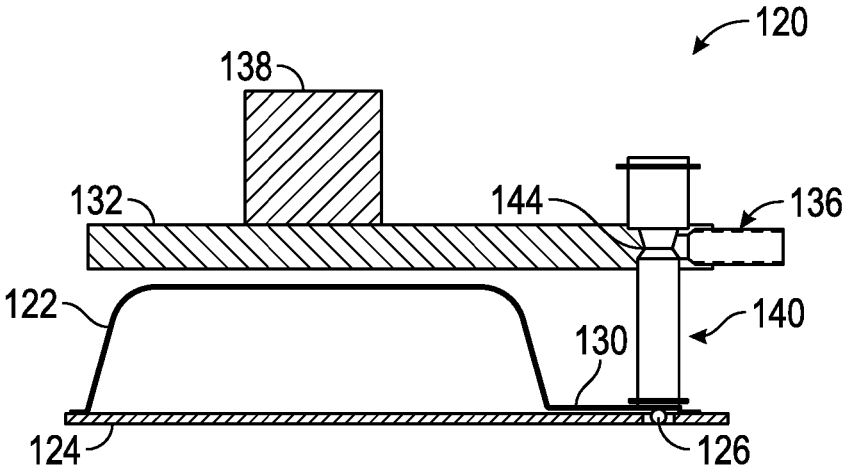

As shown in FIG. 9C, continued downward movement of the blister plate 132 by the actuator 138 causes the ball actuator 140 to collapse the sphere blister 128, thereby pushing the opening device, e.g., sphere 126, through a partition blocking fluid flow from the vessel 122. In this regard, it will be appreciated that the detent must provide a holding force sufficient to prevent the ball actuator 140 from sliding relative to the blister plate 132 until after the sphere 126 has pierced the partition. Thus, the detent must provide a holding force sufficient to collapse the sphere blister 128 and push the sphere 126 through a partition.

Figure 9D:
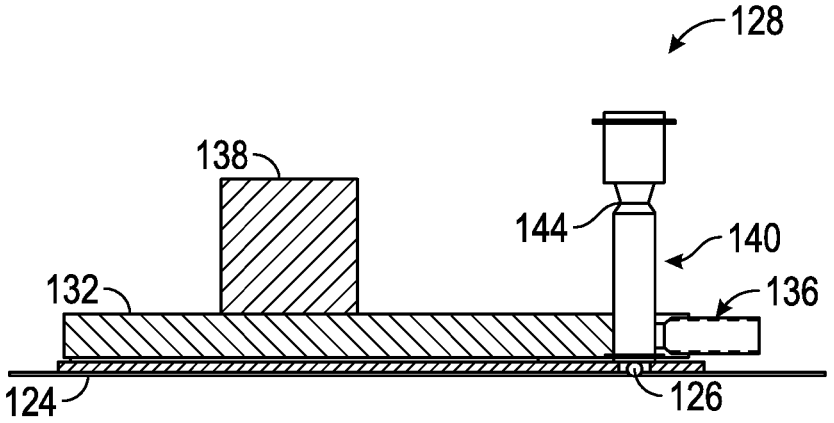

As shown in FIG. 9D, continued downward movement of the blister plate 132 by the actuator 138 eventually overcomes the holding force provided by the detent 136, and the ball actuator 140 is then released to move relative to the blister plate 132, so that the blister plate can continue to move down and collapse the vessel 122.

After the vessel 122 is collapsed, the blister plate 132 can be raised by the actuator 138 to the position shown in FIG. 9A. As the blister plate 132 is being raised from the position shown in FIG. 9D to the position shown in 9A, a hard stop 146 contacts a top end of the ball actuator 140 to prevent its continued upward movement, thereby sliding the ball actuator 140 relative to the blister plate 132 until the detent 136 contacts the detent collar 144 to reset the ball actuator 140.

Figure 10:
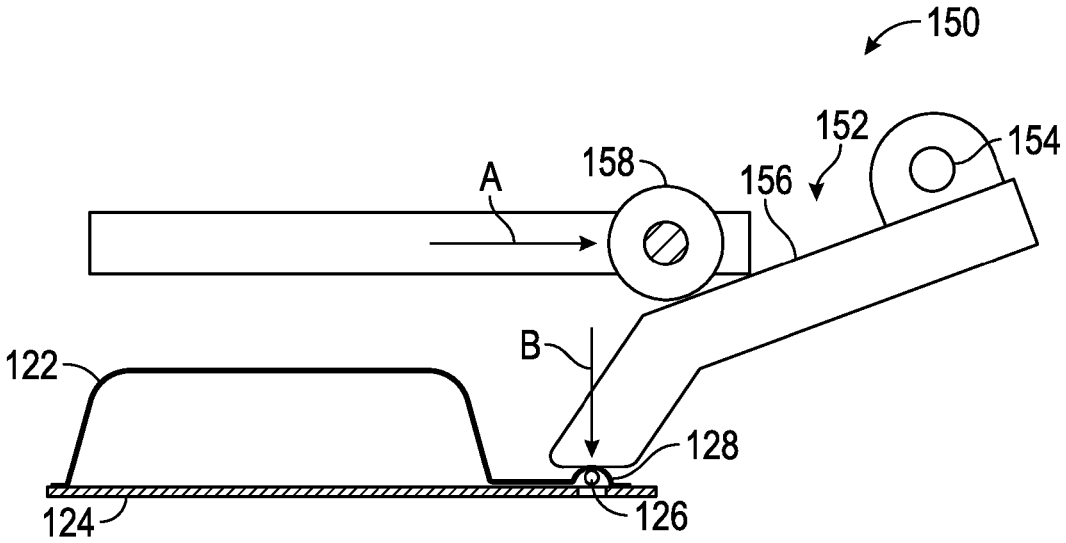
FIG. 10 is a side view of an alternative embodiment of an apparatus for opening a collapsible vessel configured to facilitate opening of the vessel.

An alternative embodiment of an apparatus for opening a vessel embodying aspects of the present invention is indicated by reference number 150 in FIG. 10. Apparatus 150 includes a pivoting ball actuator 152 configured to pivot about a pivot pin 154. A top surface 156 of the pivoting ball actuator 152 comprises a cam surface, and a cam follower 158, comprising a roller, moving in the direction "A" along the cam surface 156 pivots the actuator 152 down in the direction "B" to collapse the sphere blister 128 and force the sphere 126 through the foil partition 125. Pivoting actuator 152 may further include a torsional spring (not shown) or other means for restoring the actuator to an up position disengaged with the sphere blister 128 when the cam follower 158 is withdrawn.

Figure 12:
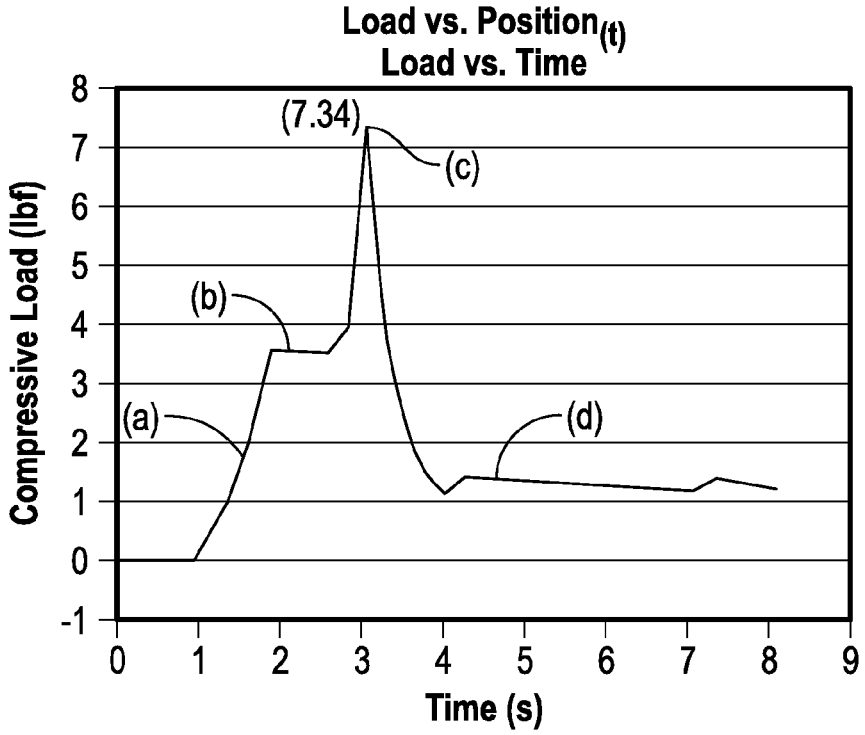
FIG. 12 is a load versus time plot of the compression load versus time during a blister compression.

FIG. 12 is a plot of compressive load versus time showing an exemplary load versus time curve for an apparatus for opening a vessel embodying aspects of the present invention. As the apparatus contacts and begins to compress the sphere blister 128, the load experiences an initial increase as shown at portion (a) of the graph. A plateau shown at portion (b) of the graph occurs after the sphere 126 penetrates the foil partition 125. A second increase in the force load occurs when the blister plate 132 makes contact with and begins compressing the vessel 122. A peak, as shown at part (c) of the plot, is reached as a breakable seal within channel 130 between the vessel 122 and the sphere blister 128 is broken. After the seal has been broken, the pressure drops dramatically, as shown at part (d) of the plot, as the vessel 122 is collapsed and the fluid contained therein is forced through the exit port 123 (See FIGS. 8A, 8B) supporting the sphere 126.

Figure 13A:
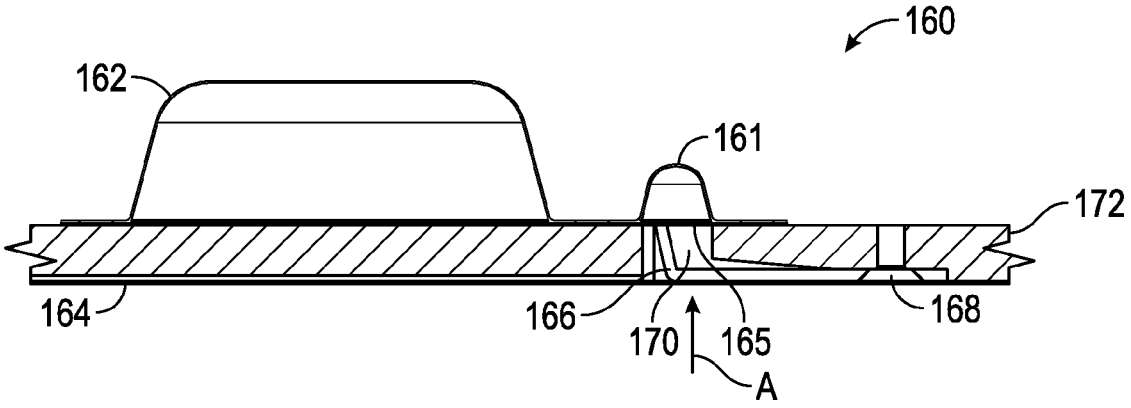
FIG. 13A is a partial, cross-sectional side view of an alternative apparatus for opening a collapsible vessel configured to facilitate opening of the vessel.
Figure 13B:
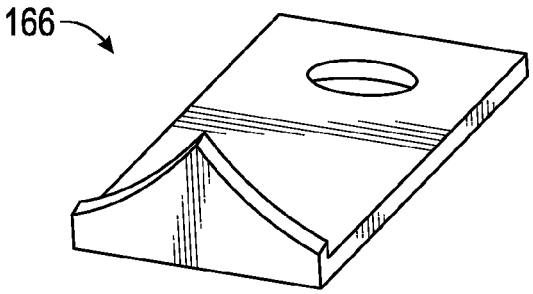
FIG. 13B is a perspective view of a cantilever lance used in the embodiment of FIG. 13A.

An alternative apparatus for opening a vessel is indicated by reference number 160 in FIG. 13A. As shown in FIG. 13A, a fluid vessel (or blister) 162 is mounted on a substrate 172 and is connected by means of a channel—which may or may not be initially blocked by a breakable seal—to a dimple 161. A film layer 164 may be disposed on the bottom of the substrate 172 to cover one or more channels formed in the bottom of the substrate 172 to form fluid conduits. An opening device comprising a cantilevered lance 166 is positioned within a lance chamber 170 formed in the substrate 172 where it is anchored at an end thereof by a screw attachment 168.

A foil partition or septum 165 seals the interior of the dimple 161 from the lance chamber 170. An actuator pushes the lance 170 up in the direction "A" into the dimple 161, thereby piercing the foil partition 165 and permitting fluid to flow from the blister 162 out of the lance chamber 170 and a fluid exit port. The spring force resilience of the lance 166 returns it to its initial position after the upward force is removed. In one embodiment, the lance 166 is made of metal. Alternatively, a plastic lance could be part of a molded plastic substrate on which the blister 162 is formed. Alternatively, a metallic lance could be heat staked onto a male plastic post. A further option is to employ a formed metal wire as a lance.

Figure 14:
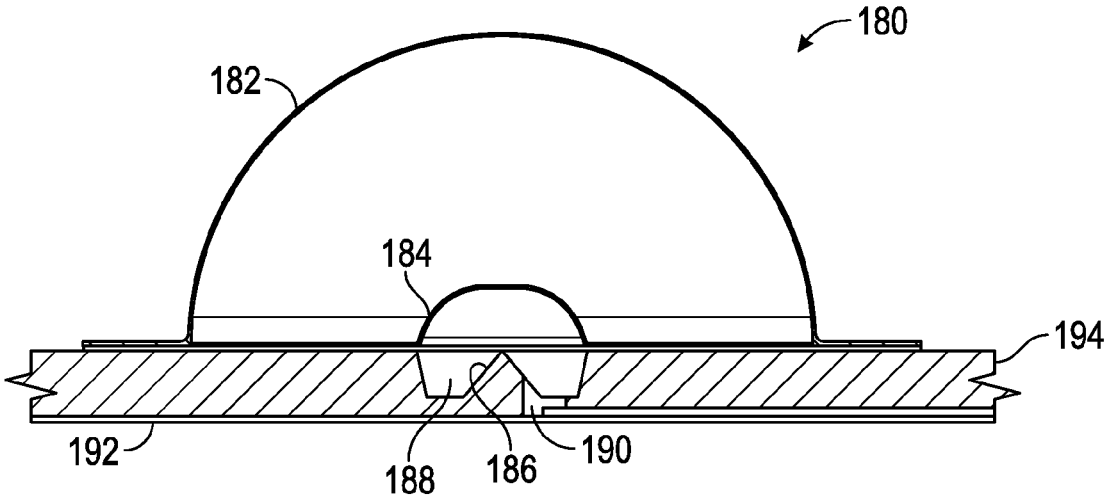
FIG. 14 is a partial, cross-sectional side view of an alternative apparatus for opening a collapsible vessel configured to facilitate opening of the vessel.

A further alternative embodiment of an apparatus for opening a vessel is indicated by reference number 180 in FIG. 14. A component having one or more deformable vessels includes at least one blister 182 formed on a substrate 194. In the arrangement shown in FIG. 14, an internal dimple 184 is formed inside the blister 182. Internal dimple 184 encloses an opening device comprising a fixed spike 186 projecting upwardly from a spike cavity 188 formed in the substrate 194.

A film layer 192 is disposed on an opposite side of the substrate 194. As an actuator presses down on the blister 182, internal pressure within the blister 182 causes the internal dimple 184 to collapse and invert. The inverted dimple is punctured by the fixed spike 186, thereby permitting fluid within the blister 182 to flow through an exit port 190.

Figure 15A:
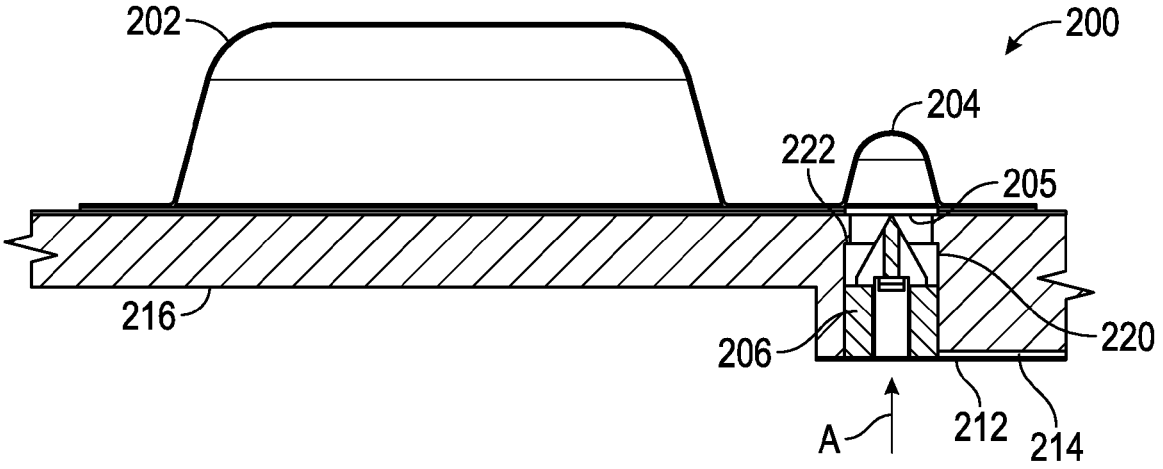
FIG. 15A is a partial, cross-sectional side view of an alternative apparatus for opening a collapsible vessel configured to facilitate opening of the vessel.
Figure 15B:
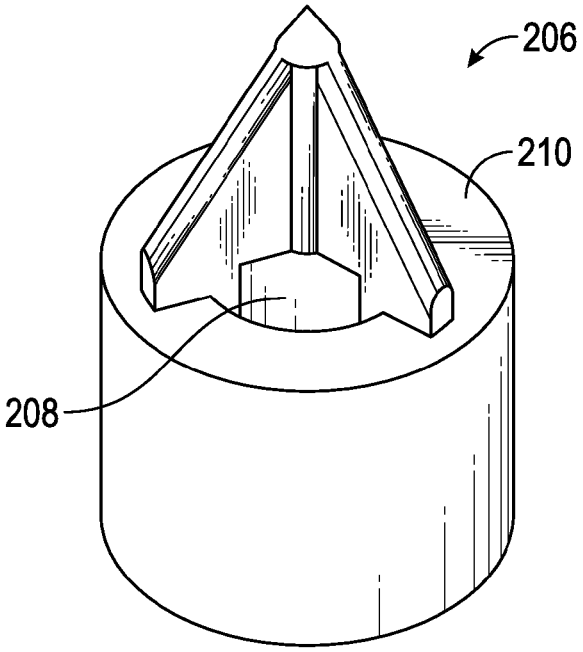
FIG. 15B is a perspective view of a lancing pin used in the apparatus of FIG. 15A.

An alternative apparatus for opening a vessel is indicated by reference number 200 in FIG. 15A. As shown in FIG. 15A, a fluid vessel (or blister) 202 is mounted on a substrate 216 and is connected by means of a channel—which may or may not be initially blocked by a breakable seal—to a dimple 204. An opening device comprising a lancing pin 206 having a fluid port 208 formed through the center thereof (see FIG. 15B) is disposed within a segmented bore 220 formed in the substrate 216 beneath the dimple 204. A partition or septum 205 separates the dimple 204 from the bore 220, thereby preventing fluid from exiting the blister 202 and dimple 204. An actuator (not shown) presses on a film layer 212 disposed on a bottom portion of the substrate 216 in the direction "A" forcing the lancing pin 206 up within the segmented bore 220 until a shoulder 210 formed on the lancing pin 206 encounters a hard stop 222 formed in the segmented bore 220. A lancing point of the pin 206 pierces the partition 205 thereby permitting fluid to flow through the fluid port 208 in the lancing pin 206 and out of a fluid exit channel 214.

Figure 16A:
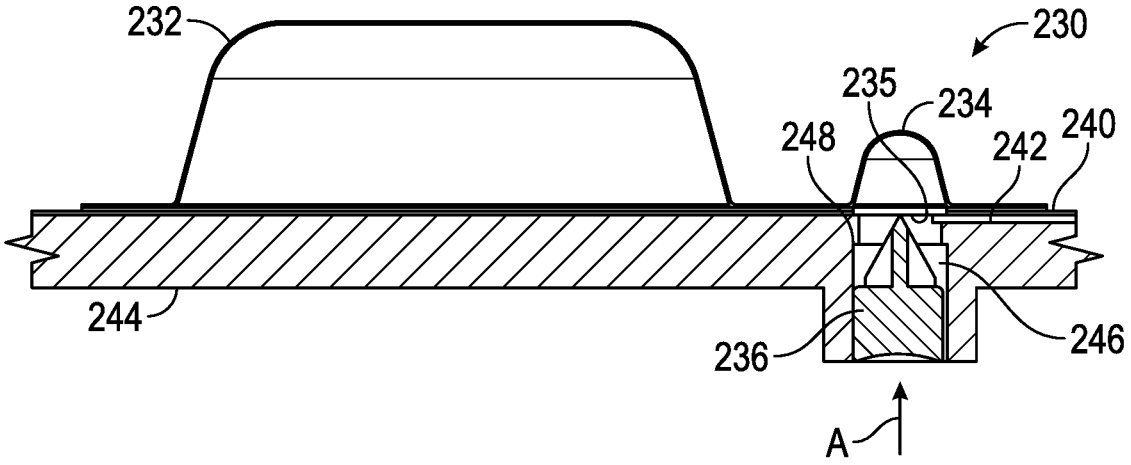
FIG. 16A is a partial, cross-sectional side view of an alternative apparatus for opening a collapsible vessel configured to facilitate opening of the vessel.
Figure 16B:
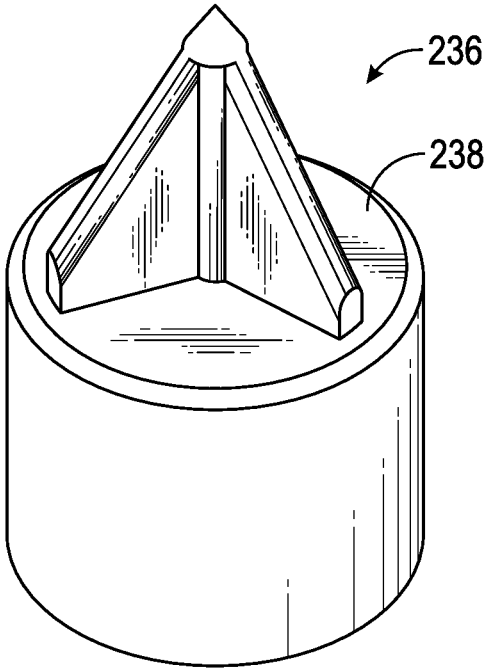
FIG. 16B is a perspective view of a lancing pin used in the apparatus of FIG. 16A.

An alternative embodiment of an apparatus for opening a vessel is indicated by reference number 230 in FIGS. 16A and 16B. As shown in FIG. 16A, a fluid vessel (or blister) 232 is mounted on a substrate 244 and is connected by means of a channel—which may or may not be initially blocked by a breakable seal—to a dimple 234. An opening device comprising a lancing pin 236 is disposed within a segmented board 246 formed in the substrate 244 beneath the dimple 234. A partition or septum 235 separates the dimple 234 from the segmented bore 246. The upper surface of the substrate 244 is sealed with a film 240 before the blister 232 and dimple 234 are adhered. An actuator (not shown) pushes up on the lancing pin 236 in the direction "A" until a shoulder 238 formed on the lancing pin 236 encounters hard stop 248 within the bore 246. The pin 236 thereby pierces the partition 235 and remains in the upper position as fluid flows out along an exit channel 242 formed on an upper surface of the substrate 244. A fluid tight seal is maintained between the pin 238 and the bore 246 by a slight interference fit.

As the collapsible fluid vessels of a liquid reagent module are configured to be compressed and collapsed to displace the fluid contents from the vessel(s), such vessels are susceptible to damage or fluid leakage due to inadvertent exposures to contacts that impart a compressing force to the vessel. Accordingly, when storing, handling, or transporting a component having one or more collapsible fluid vessels, it is desirable to protect the fluid vessel and avoid such inadvertent contact. The liquid reagent module could be stored within a rigid casing to protect the collapsible vessel(s) from unintended external forces, but such a casing would inhibit or prevent collapsing of the vessel by application of an external force. Thus, the liquid reagent module would have to be removed from the casing prior to use, thereby leaving the collapsible vessel(s) of the module vulnerable to unintended external forces.

Figure 17:
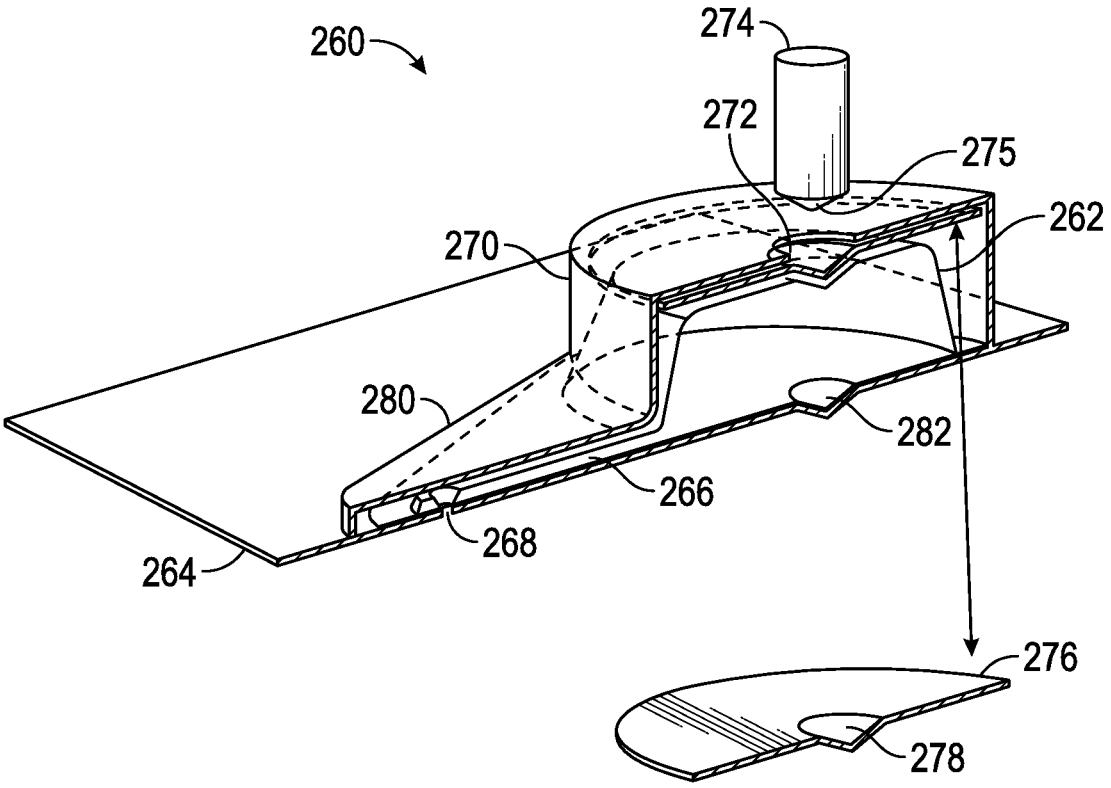
FIG. 17 is an exploded, cross-sectional, perspective view of an apparatus for protecting and interfacing with a collapsible vessel.
Figure 18:
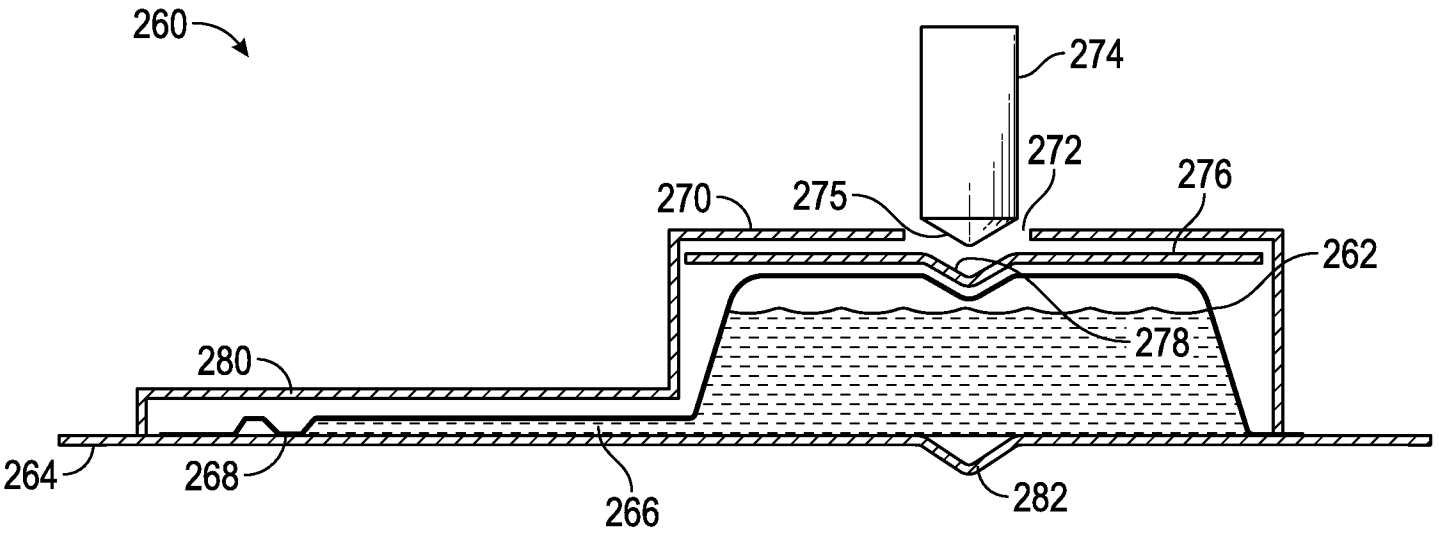
FIG. 18 is a cross-sectional, side view of the apparatus for protecting and interfacing with a collapsible vessel in an unactuated state.
Figure 19:
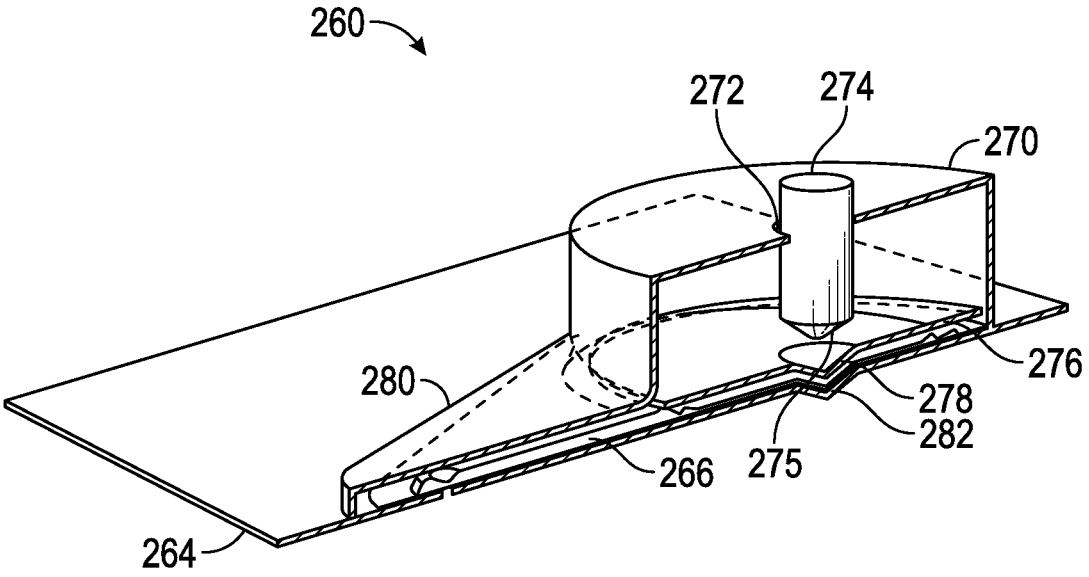
FIG. 19 is a cross-sectional, perspective view of the apparatus for protecting and interfacing with a collapsible vessel in fully actuated state.

An apparatus for protecting and interfacing with a collapsible vessel is indicated by reference number 260 in FIGS. 17, 18, and 19. A component with one or more collapsible vessels includes a collapsible blister 262 formed on a substrate 264. A dispensing channel 266 extends from the blister 262 to a frangible seal 268. It is understood that, in some alternative embodiments, the dispensing channel 266 may be substituted with a breakable seal, providing an additional safeguard against an accidental reagent release.

Frangible seal 268 may comprise one of the apparatuses for opening a vessel described above and shown in any of FIGS. 8-16.

A rigid or semi-rigid housing is provided over the blister 262 and, optionally, the dispensing channel 266 as well, and comprises a blister housing cover 270 covering the blister 262 and a blister housing extension 280 covering and protecting the dispensing channel 266 and the area of the frangible seal 268.

A floating actuator plate 276 is disposed within the blister housing cover 270. In the illustrated embodiments, both the blister housing cover 270 and the floating actuator plate 276 are circular, but the housing 270 and the actuator plate 276 could be of any shape, preferably generally conforming to the shape of the blister 262.

The apparatus 260 further includes a plunger 274 having a plunger point 275 at one end thereof. Plunger 274 is disposed above the blister housing cover 270 generally at a center portion thereof and disposed above an aperture 272 formed in the housing 270.

The floating actuator plate 276 includes a plunger receiver recess 278, which, in an embodiment, generally conforms to the shape of the plunger point 275.

The blister 262 is collapsed by actuating the plunger 274 downwardly into the aperture 272. Plunger 274 may be actuated by any suitable mechanism, including one of the actuator mechanisms 50, 80 described above. Plunger 274 passes into the aperture 272 where the plunger point 275 nests within the plunger receiver recess 278 of the floating actuator plate 276. Continued downward movement by the plunger 274 presses the actuator plate 276 against the blister 262, thereby collapsing the blister 262 and displacing fluid from the blister 262 through the dispensing channel 266 to a fluid egress. Continued pressure will cause the frangible seal at 268 to break, or an apparatus for opening the vessel as described above may be employed to open the frangible seal. The plunger point 275 nested within the plunger point recess 278 helps to keep the plunger 274 centered with respect to the actuator plate 276 and prevents the actuator plate 276 from sliding laterally relative to the plunger 274. When the blister is fully collapsed, as shown in FIG. 19, a convex side of the plunger receiver recess 278 of the floating actuator plate 276 nests within a plunger recess 282 formed in the substrate 264.

Accordingly, the blister housing cover 270 protects the blister 262 from inadvertent damage or collapse, while the floating actuator plate inside the blister housing cover 270 permits and facilitates the collapsing of the blister 262 without having to remove or otherwise alter the blister housing cover 270. In components having more than one collapsible vessel and dispensing channel, a blister housing cover may be provided for all of the vessels and dispensing channels or for some, but less than all vessels and dispensing channels.

While the present invention has been described and shown in considerable detail with reference to certain illustrative embodiments, including various combinations and sub-combinations of features, those skilled in the art will readily appreciate other embodiments and variations and modifications thereof as encompassed within the scope of the present invention. Moreover, the descriptions of such embodiments, combinations, and sub-combinations is not intended to convey that the inventions requires features or combinations of features other than those expressly recited in the claims. Accordingly, the present invention is deemed to include all modifications and variations encompassed within the spirit and scope of the following appended claims.

The invention claimed is:

1. A fluid container comprising:

a first vessel;

a second vessel connected or connectable to the first vessel;

a sealing partition preventing fluid flow from the second vessel; and a solid spherical opening element initially supported within the second vessel by the sealing partition and configured to be contacted with the sealing partition to open the sealing partition and permit fluid flow from the second vessel, wherein the first vessel comprises a first collapsible blister supported on a planar substrate, and the second vessel comprises a second collapsible blister supported on the substrate.

2. The fluid container of claim 1, further comprising a fluid channel extending between the first and second vessels.

3. The fluid container of claim 2, further comprising a seal within the fluid channel, the seal being configured to be breakable upon application of sufficient force to the seal to thereby connect the first and second vessels via the fluid channel.

4. The fluid container of claim 1, further comprising a fluid channel formed in the substrate and extending between the first and second vessels.

5. The fluid container of claim 1, further comprising an opening formed in the substrate below the second vessel, wherein the sealing partition is disposed over the opening and the solid spherical opening element is disposed within the second vessel and supported above the opening on the sealing partition.

6. The fluid container of claim 5, wherein the solid spherical opening element is configured to be contacted with the sealing partition by collapsing the second vessel and pushing the solid spherical opening element through the sealing partition and into the opening.

7. The fluid container of claim 1, wherein the solid spherical opening element comprises a steel ball.

8. The fluid container of claim 1, wherein the sealing partition comprises a foil.

9. The fluid container of claim 6, further comprising a channel formed in the substrate and extending from the opening to permit fluid flowing from the second vessel and into the opening to flow through the channel.

10. A method for displacing fluid from a fluid container including a first vessel and a second vessel connected or connectable to the first vessel and including a sealing partition preventing fluid flow from the second vessel, wherein the fluid container further includes a solid spherical opening element disposed within the second vessel, said method comprising:

(a) applying a compressive force to the second vessel sufficient to collapse the second vessel and push the solid spherical opening element disposed within the second vessel into the sealing partition with sufficient force to rupture the sealing partition to thereby permit fluid flow form the second vessel; and (b) applying a compressive force to the first vessel sufficient to collapse the first vessel and force fluid from the first vessel to the second vessel, whereby fluid forced into the second vessel flows out of the second vessel through the ruptured sealing partition.

11. The method of claim 10, wherein the second vessel is supported on a substrate which comprises an opening formed in the substrate below the second vessel and wherein the sealing partition is disposed over the opening and the solid spherical opening element is supported above the opening on the sealing partition, and step (a) comprises pushing the solid spherical opening element through the sealing partition and into the opening formed in the substrate below the second vessel.

12. The method of claim 10, wherein step (a) is performed with a first external actuator configured to apply a compressive force to the second vessel, and step (b) is performed with a second external actuator configured to apply a compressive force to the first vessel.

13. The method of claim 10, wherein step (b) is performed after step (a) is performed.

14. The method of claim 10, wherein the fluid container includes a fluid channel extending between the first vessel and the second vessel with a fluid-blocking seal within the fluid channel, and wherein step (b) comprises applying sufficient force to alter the seal and thereby connect the first and second vessels via the fluid channel.

* * * * *